US010895232B2

(12) United States Patent
Kochanski et al.

(10) Patent No.: US 10,895,232 B2
(45) Date of Patent: Jan. 19, 2021

(54) FUEL PUMP MOUNTING

(71) Applicant: Ford Global Technologies, LLC, Dearborn, MI (US)

(72) Inventors: Kevin J. Kochanski, Oxford, MI (US); David Matthew Gasior, Livonia, MI (US); Claude Weston Bailey, III, Macomb, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 16/591,454

(22) Filed: Oct. 2, 2019

(65) Prior Publication Data

US 2020/0032752 A1 Jan. 30, 2020

Related U.S. Application Data

(62) Division of application No. 15/422,244, filed on Feb. 1, 2017, now Pat. No. 10,473,078.

(51) Int. Cl.

| | |
|---|---|
| ***F02M 59/44*** | (2006.01) |
| ***F02M 39/02*** | (2006.01) |
| ***F02F 1/24*** | (2006.01) |
| ***F02M 55/00*** | (2006.01) |
| *F02F 11/00* | (2006.01) |
| *F02F 7/00* | (2006.01) |

(52) U.S. Cl.

CPC ..... *F02M 59/44* (2013.01); *F02F 1/24* (2013.01); *F02M 39/02* (2013.01); *F02M 55/004* (2013.01); *F02F 7/006* (2013.01); *F02F 11/00* (2013.01)

(58) Field of Classification Search

CPC ..... F02M 59/44; F02M 39/02; F02M 55/004; F02F 1/24; F02F 11/00; F02F 7/006; F02F 7/0021; F02F 7/0065

See application file for complete search history.

(56) References Cited

U.S. PATENT DOCUMENTS

| | | | | |
|---|---|---|---|---|
| 4,403,586 | A | 9/1983 | Taniguchi | |
| 4,430,977 | A | 2/1984 | Shimada | |
| 4,917,069 | A | 4/1990 | Kuhlen | |
| 5,007,401 | A | 4/1991 | Grohn et al. | |
| 6,513,504 | B2 | 2/2003 | Ikuma | |
| 6,523,518 | B2 | 2/2003 | Kunde et al. | |
| 7,114,928 | B2 | 10/2006 | Asayama et al. | |
| 7,650,876 | B2 | 1/2010 | Liedtke et al. | |
| 2011/0155084 | A1* | 6/2011 | Sargeant | F01L 1/053 123/90.15 |

* cited by examiner

*Primary Examiner* — Xiao En Mo

(74) *Attorney, Agent, or Firm* — Geoffrey Brumbaugh McCoy Russell LLP

(57) ABSTRACT

Methods and systems are provided for mounting a fuel pump to a cylinder head of an engine. In one example, a mounting system may comprise: an engine fuel pump mounted directly to a cylinder head cap positioned underneath a cam cover, the cap including a raised portion having a first and a second cap mounting boss, and a main opening for directly receiving the fuel pump, wherein each of the first and second cap mounting bosses couple to a flange formed on a bottom portion of the fuel pump. In this way, the fuel pump may be directly mounted to the cylinder head cap to simplify assembly, minimize fuel leakage and reduce pump vibration.

15 Claims, 16 Drawing Sheets

FUEL PUMP MOUNTING

CROSS REFERENCE TO RELATED APPLICATION

The present application is a divisional of U.S. Non-Provisional patent application Ser. No. 15/422,244, entitled "FUEL PUMP MOUNTING," and filed on Feb. 1, 2017. The entire contents of the above-referenced application are hereby incorporated by reference for all purposes.

FIELD

The present description relates generally to methods and systems for mounting a fuel pump to a cylinder head of an engine.

BACKGROUND/SUMMARY

An engine fuel pump may be mounted to a pump pedestal secured to a cylinder head of an internal combustion engine. In order to reduce vibration and minimize fuel leakage, the fuel pump may be mounted to the pump pedestal using sealing gaskets and a plurality of fasteners. The pump pedestal may be adequately secured to the cylinder head, to minimize movement of the pedestal and pump assembly during engine operation.

One example approach of mounting a fuel pump to a cylinder head is shown by Kunde et al. in U.S. Pat. No. 6,523,518. Therein, the fuel pump is mounted to a cylinder holder using a mounting plate, an external gasket and a cylinder head cover having an opening to receive a lower portion of the pump. The fuel pump is secured to the cylinder holder via a plurality of fasteners extended through thread bores in the holder.

However, the inventors herein have recognized potential issues with such a system. As an example, the mounting plate used in conjunction with the external gasket may introduce additional assembly complexity. Further, the external gasket positioned between the mounting plate and cylinder holder, may cause leakage if not adequately installed. In addition, the external gasket may be exposed to increased wear and tear, which may decrease lifespan of the gasket.

In one example, the issues described above may be addressed by a system comprising: an engine fuel pump mounted directly to a cylinder head cap positioned underneath a cam cover, the cap including a raised portion having a first and a second cap mounting boss, and a main opening for directly receiving the fuel pump, wherein each of the first and second cap mounting bosses couple to a flange formed on a bottom portion of the fuel pump. In this way, the fuel pump may be directly mounted to the cylinder head cap to reduce assembly complexity while minimizing fuel leakage from the pump assembly.

As an example, the flange of the fuel pump may be directly mounted to the raised portion of the cylinder head cap, and secured using a plurality of fasteners extended through each of the first and second cap mounting bosses. In one example, the raised portion of the cylinder head cap may include a recessed slot to receive a press-in-place (PIP) gasket. In an alternative example, the press-in-place (PIP) gasket may be positioned in a recessed groove formed in an interior region of the cam cover. The cam cover may be configured with an enclosure that fits the raised portion of the cylinder head cap and supports the flange of the fuel pump. In this case, directly mounting the fuel pump to the cylinder head cap may confer several advantages. For example, a portion of the press-in-place (PIP) gasket may be secured inside the recessed slot on cylinder head cap or the recessed groove in the cam cover to minimize slippage of the gasket, and to provide a tight seal between the fuel pump, cap and cam cover. By directly mounting the fuel pump to the cylinder head cap, pump assembly may be simplified to minimize fuel leakage while reducing vibration of the assembly.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-14 are shown approximately to scale, although other relative dimensions may be used, if desired.

DETAILED DESCRIPTION

Figure 1:
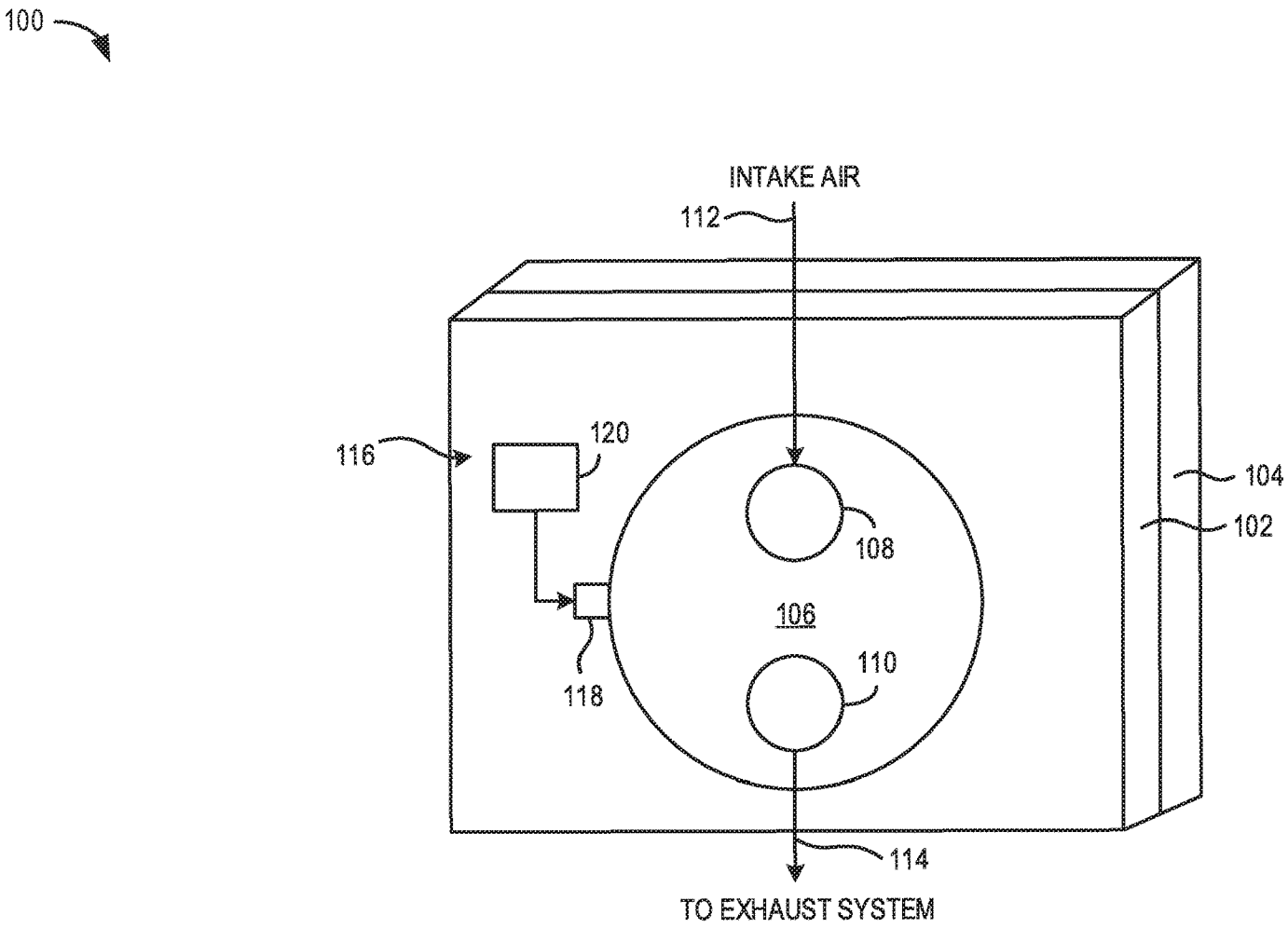
FIG. 1 shows a schematic depiction of an engine system comprising a cylinder head mounted to a cylinder block.
Figure 2:
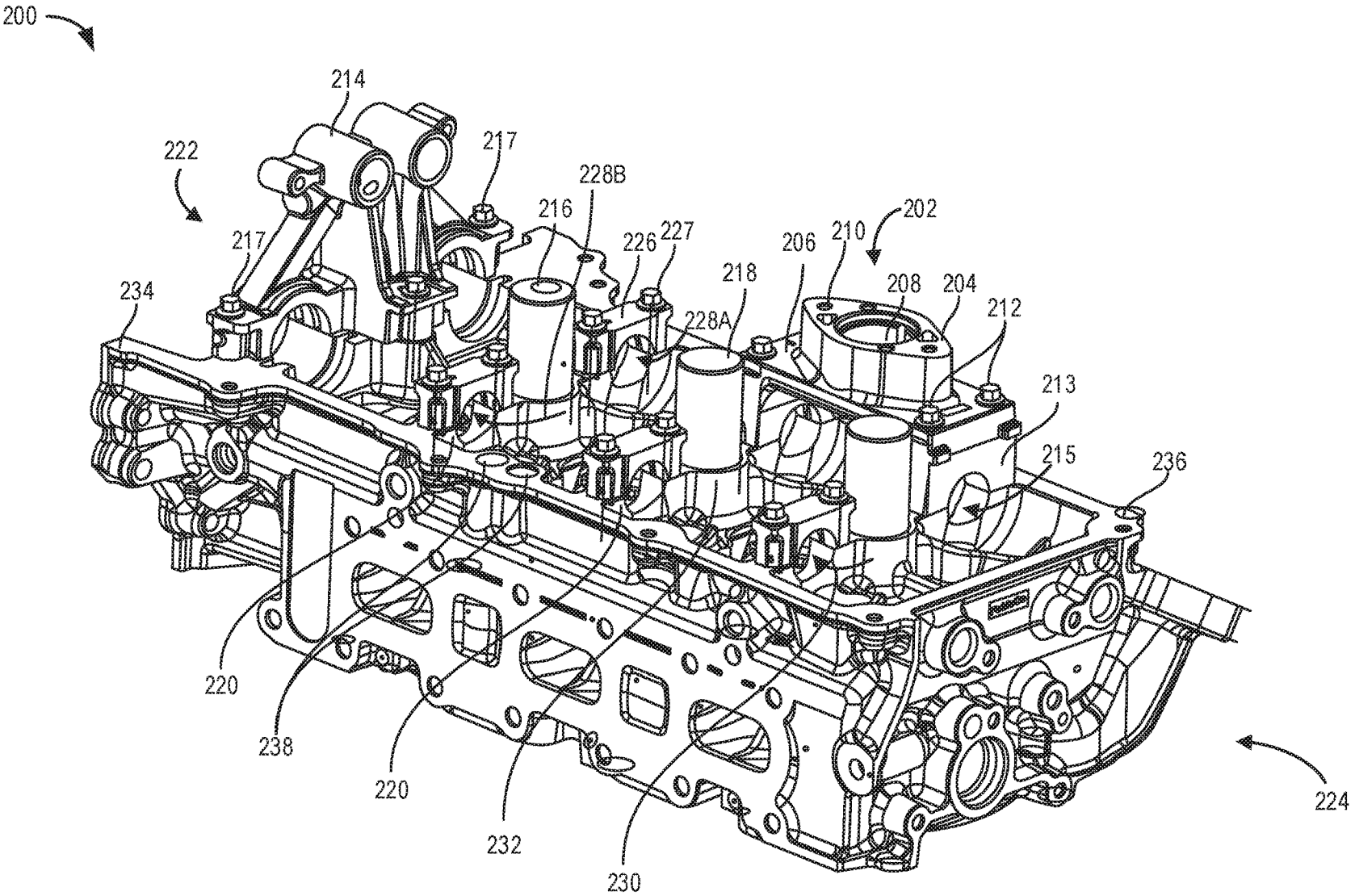
FIG. 2 shows a schematic depiction of a first embodiment of a cylinder head cap mounted to a cylinder head of the engine.
Figure 6:
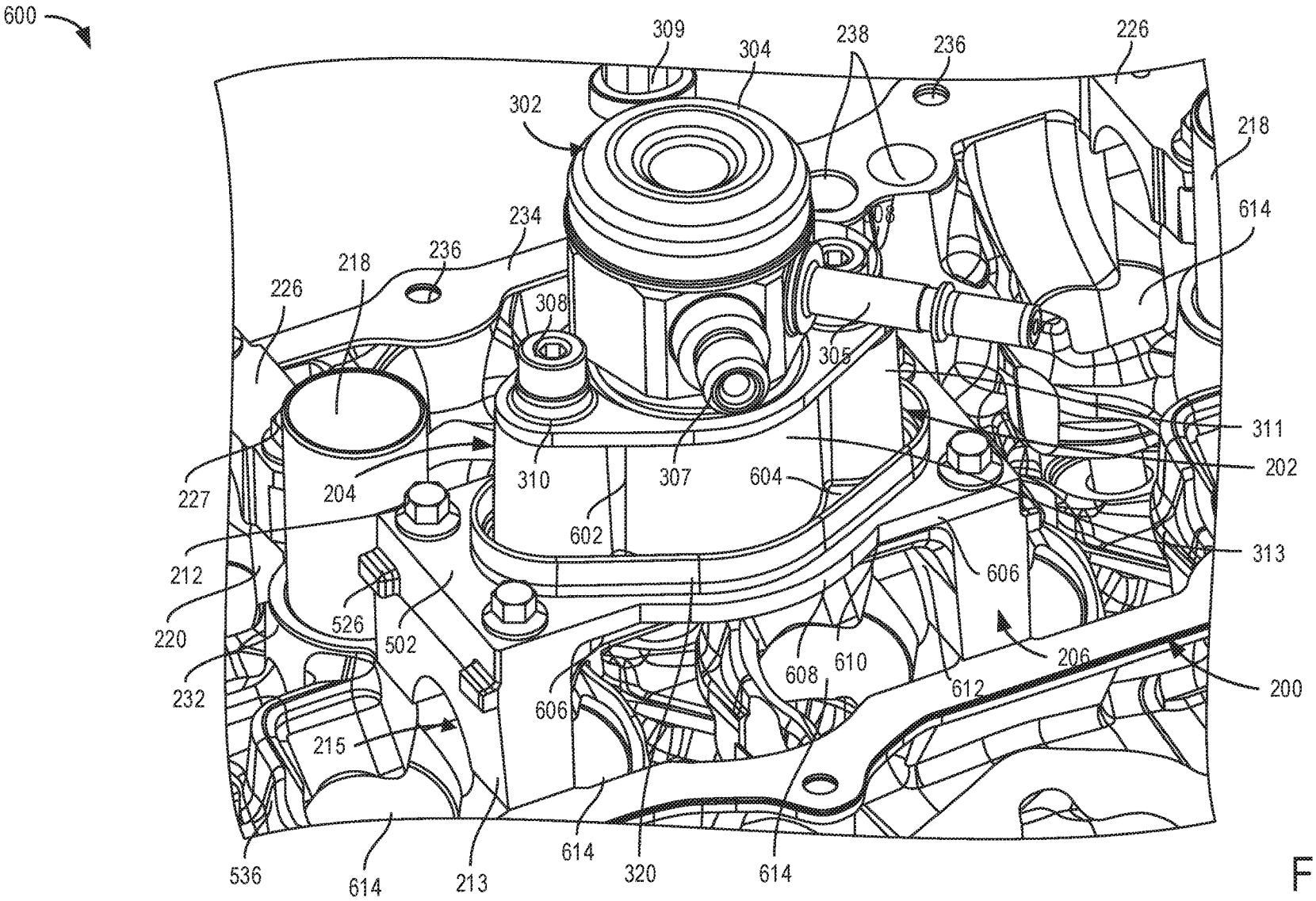
FIG. 6 shows a schematic depiction of the fuel pump mounted to the first embodiment of the cylinder head cap secured to the cylinder head, with the cam cover removed.
Figure 7:
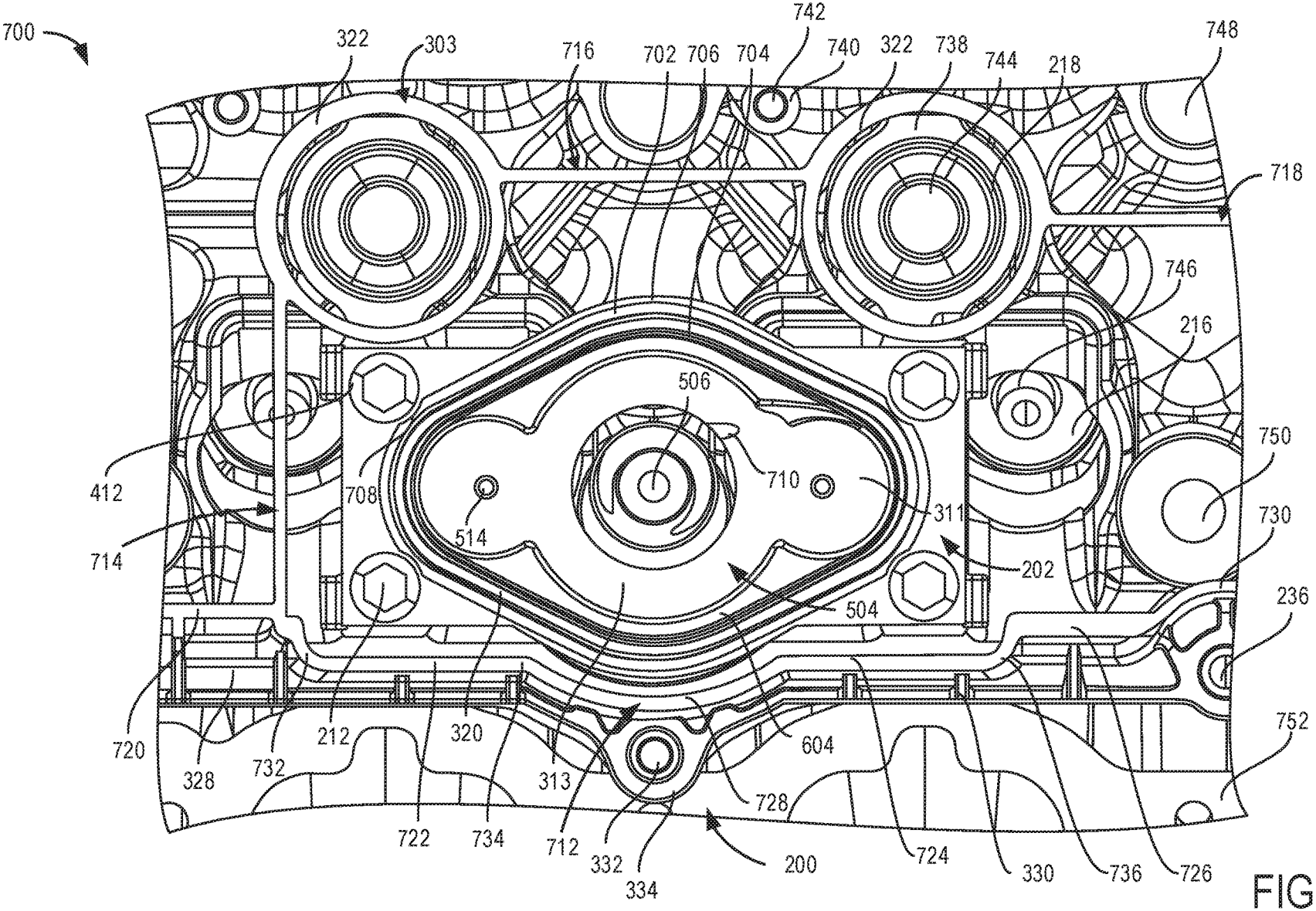
FIG. 7 shows a plan view of the fuel pump mounted to the first embodiment of the cylinder head cap secured to the cylinder head.

The following description relates to systems and methods for mounting a fuel pump to a cylinder head of an engine. FIG. 1 shows an engine system comprising a cylinder head mounted to a cylinder block. A fuel delivery system including a fuel pump and other accessories may be provide to supply fuel to one or more cylinders in the engine. The fuel pump may be mounted to a cylinder head cap secured to the cylinder head. As shown in FIG. 2, the cylinder head cap may be secured to the cylinder head via a plurality of fasteners. The cylinder head cap may include a top portion that may support a flange of the fuel pump. In this case, the fuel pump may be directly mounted to the cylinder head cap without using a mounting plate to simplify pump assembly. As an example, the fuel pump may be mounted to the cylinder head cap, with the flange of the pump making face contact with the top portion of the cap, as shown in the first embodiment of the cylinder head cap in FIGS. 3A-7. The top portion of the cylinder head cap may include a plurality of cap mounting bosses and an inner portion configured with a main opening to receive a portion of the fuel pump. The flange of the fuel pump may include a plurality of bosses that may be configured to mate with the plurality of cap mounting bosses on the cylinder head cap, forming openings to receive fasteners for securing the fuel pump to the cap. A cam cover, having an enclosure for the top portion of the cylinder head cap, may be placed over the cap and secured to the cylinder head using a combination of dowels and bolts or other suitable means of mechanical assembly. The enclosure on the cam cover may be adequately sized to receive each cap mounting boss and the inner portion of the cylinder head cap. The main opening in the inner portion of the cylinder head cap, may be adequately sized to receive a portion of the fuel pump, such as a ram with compression springs. The fuel pump may be configured to supply fuel to a plurality of cylinders mounted in the cylinder block attached to the cylinder head. A plurality of ribs, formed on an exterior portion of the cam cover, may provide structural integrity to the cover. The cam cover may also include a plurality of openings to receive spark plug tubes mounted to the cylinder head. As shown in FIGS. 6-7, a press-in-place gasket may be installed at a base region of the lower portion of the cylinder head cap to minimize fuel leakage in the pump assembly. In other embodiments, the press-in-place gasket may be positioned in a recessed groove formed on the cam cover to minimize slippage of the gasket, and to provide a tight seal between the fuel pump, cap and cam cover.

Alternatively, the fuel pump may be mounted to a second embodiment of a cylinder head cap shown in FIGS. 8-11. The cylinder head cap in the second embodiment may include an upper section, a middle section and a lower section. The upper section may include a plurality of cap mounting bosses and an inner portion having a main opening to receive a portion of the fuel pump. The cap mounting bosses and inner portion, may be different from the mounting bosses of the top portion of cylinder head cap in the first embodiment of the cap. The middle section may include a large section of a middle portion of the cylinder head cap. The lower section may include a small section of the middle portion, and support members of the cylinder head cap, including a cross member. A press-in-place gasket may be installed on a top surface of the middle portion of the cylinder head cap to minimize fuel leakage in the pump assembly. The cylinder head cap may be secured to the cylinder head via a plurality of fasteners extended through each support member of the cap.

Figure 12:
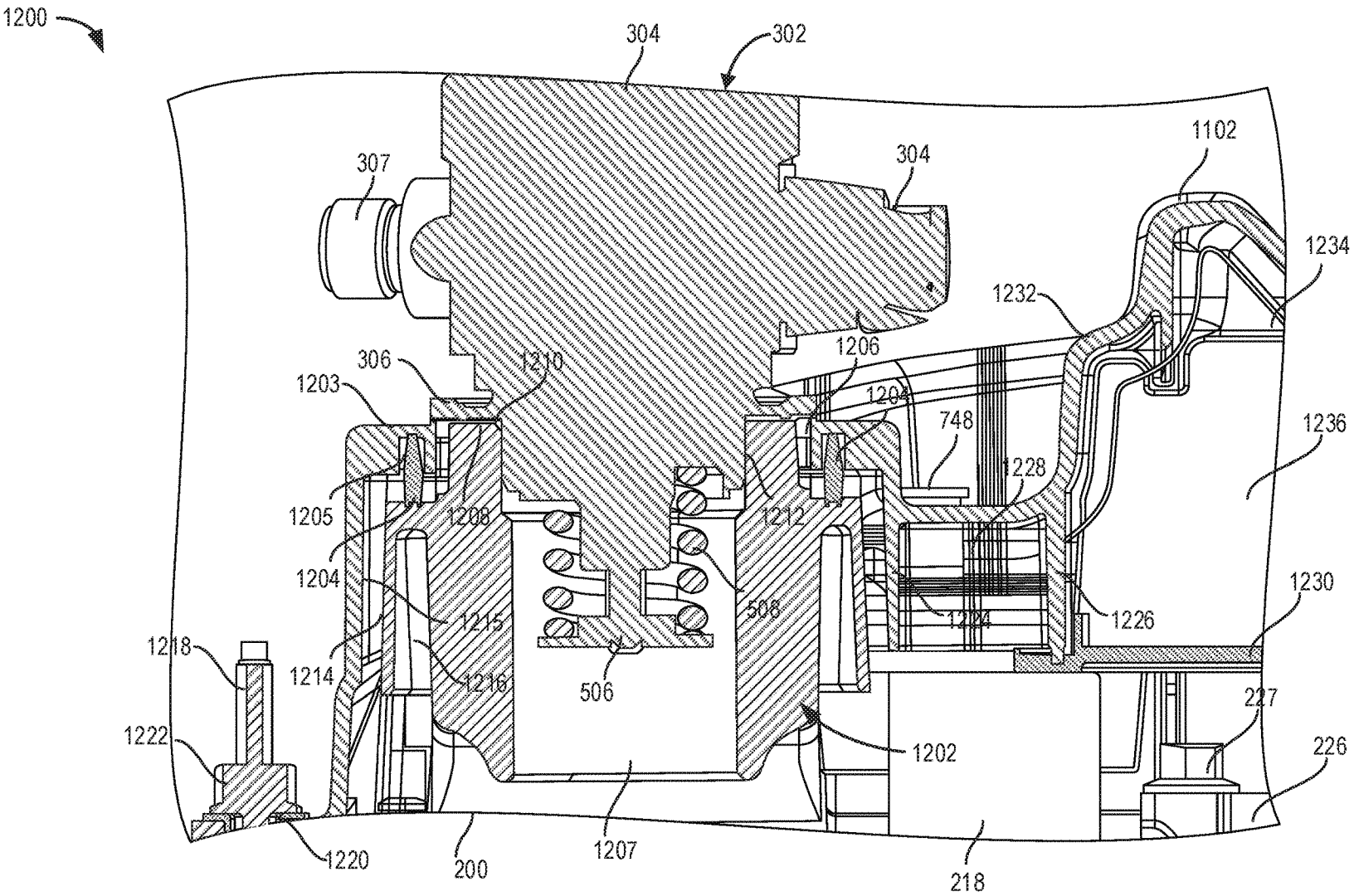
FIG. 12 shows a cross section view through the fuel pump mounted to an alternative embodiment of a cylinder head cap secured to the cylinder head.

In an alternative example, the fuel pump may be mounted to an alternative embodiment of a cylinder head cap secured to the cylinder head, as shown in FIG. 12. The fuel pump may be directly mounted to the cylinder head cap, without a mounting plate, thereby simplifying pump assembly. When mounted, a portion of the fuel pump, such as the ram configured with compression springs, may be disposed in a main opening in the cap to deliver fuel to cylinders mounted to the cylinder block attached to the cylinder head. A modified cam cover, different from the cover disclosed in the first embodiment of the cap, may be mounted over the cylinder head cap and secured to the cylinder head.

Figure 13:
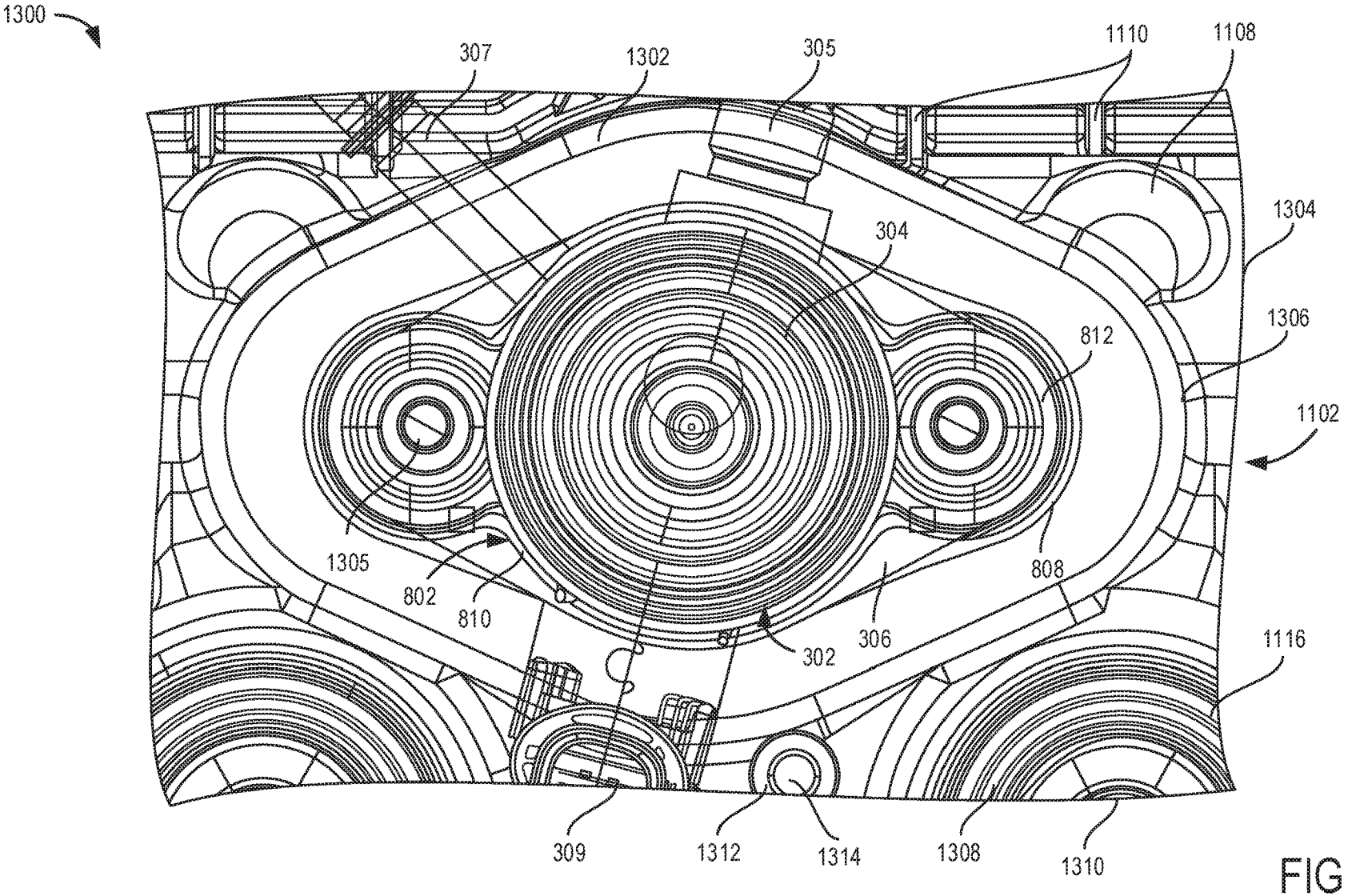
FIG. 13 shows a plan view of the fuel pump mounted to the second embodiment of the cylinder head cap, with the cam cover secured over the cap.
Figure 14:
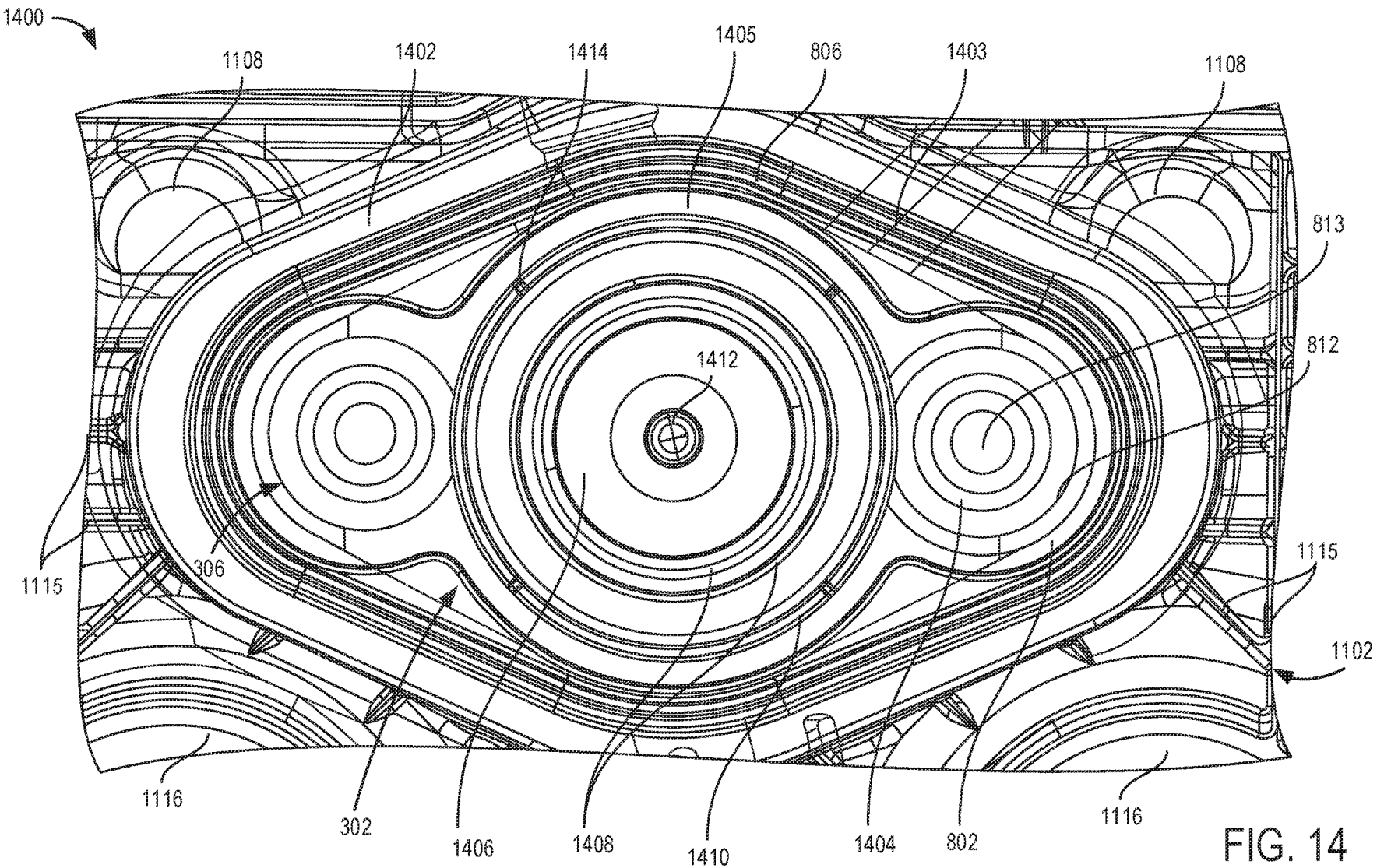
FIG. 14 shows an alternative view of the fuel pump mounted to the second embodiment of the cylinder head cap, with the press-in-place gasket mounted to a recessed slot on the cam cover.

Similarly, the modified cam cover may be mounted over the cylinder head cap in the second embodiment of the cap, and secured to the cylinder head, as shown in FIGS. 13-14. When mounted, the fuel pump is positioned above the cam cover, and the flange on the pump may be in face-sharing contact with the cap mounting bosses of the cylinder head cap. The fuel pump may be secured to the cap via a plurality of fasteners, extended through openings in the flange and cap mounting bosses. In this way, the fuel pump may be directly mounted to the cylinder head cap enclosed by the cam cover, with the press-in-place gasket secured to the cap and cover. By securing the press-in-place gasket to the cylinder head cap and cam cover, fuel leakage in the pump assembly may be minimized. Further, by directly mounting the fuel pump to the cylinder head cap, the pump assembly is simplified and vibration issues may be addressed.

Referring to FIG. 1, a schematic depiction of an engine 100 used to provide motive power to a vehicle, for example, is disclosed. In the depicted example, the engine 100 includes a cylinder head 102 coupled to a cylinder block 104 forming a cylinder 106. The engine 100 is configured to implement combustion operation in a cylinder 106. An intake valve 108 is provided in the engine 100 to flow intake air into the cylinder 106 at selected time intervals. Correspondingly, an exhaust valve 110 is provided in the engine 100 to flow exhaust gas out of the cylinder 106 into a downstream exhaust system at selected time intervals. Although the engine 100 is depicted as having only a single cylinder, in other examples, the engine 100 may include more than one cylinder.

Arrow 112 represents the flow of intake air from upstream intake system components such as intake conduits, an intake manifold, a throttle, a compressor, etc., to the intake valve 108. On the other hand, arrow 114 represents the flow of exhaust gas to downstream components such as exhaust conduits, an exhaust manifold, emission control device(s), a turbine, etc., from the exhaust valve 110.

A fuel delivery system 116 is also provided in the engine 100. The fuel delivery system 116 is configured to provide fuel for combustion in the cylinder 106 at desired time intervals. The fuel delivery system 116 includes a direct injector 118, in the illustrated example, and upstream components 120. The upstream components 120, such as fuel pumps, valves, conduits, etc., are configured to provide fuel to the fuel injector 118. However, a port injector configured to deliver fuel into a conduit upstream of the cylinder may be additionally or alternatively included in the fuel delivery system 116. One of the fuel pumps may be mounted to a cylinder head cap (not shown) secured to the cylinder head 102 via a plurality of fasteners as disclosed further below with reference to FIGS. 2-14. The engine 100 is configured to implement a four stroke combustion cycle in the engine. The combustion strokes include an intake stoke, a compression stroke, a combustion stroke, and an exhaust stroke, described in greater detail herein. An ignition device (not shown) may also be provided in the engine 100. The ignition device may be configured to provide spark to the cylinder 106 at selected time intervals. However, in other examples the ignition device may be omitted from the engine and the engine may be configured to perform compression ignition.

Turning to FIG. 2, a schematic of a cylinder head 200 (such as cylinder head 102 shown in FIG. 1), including a cylinder head cap 202 is disclosed. The cylinder head cap 202 may include a raised portion 204 connected to a lower portion 206. Further, the cylinder head 200 may include a variable cam timing mechanism 214, a variable displacement engine solenoid 216, and a plurality of spark plug tubes 218. The variable cam timing mechanism 214 may be mounted and secured to an upstream portion 222 of the cylinder head 200 using a plurality of fasteners 217. The spark plug tubes may be positioned in openings 232 formed adjacent to cam bearing towers 220.

As shown in FIG. 2, the raised portion 204 of the cylinder head cap 202 includes a main opening 208 to receive a fuel pump (not shown) and a plurality of secondary openings 210 to receive fasteners (not shown) for securing the fuel pump to the cylinder head cap 202. As an example, fuel pump may be mounted to the cylinder head cap to provide fuel to engine cylinders. In this example, the cylinder head cap 202 may be mounted adjacent to a downstream end 224 of the cylinder head 200. In alternative examples, the cylinder head cap 202 may be mounted at other suitable positions within the cylinder head 200. The raised portion 204 of the cylinder head cap 202 may be connected to the lower portion 206 using welding or other suitable means of mechanical assembly. The cylinder head cap 202 may be mounted to the cam bearing towers 220 and secured to the cylinder head via a plurality of fasteners 212 extended through openings in each support member 213 of the cap. Alternatively, the cylinder head cap 202 may be mounted to the cylinder head using other suitable means of mechanical assembly. When mounted to cam bearing towers 220, the support members 213 of the cylinder head cap 202 may form a plurality of openings 215 to receive a first portion of a first cam shaft (not shown).

The cylinder head 200 may include a plurality of cam caps 226 secured to the cam bearing towers 220 via a plurality of fasteners 227 to form a plurality of upstream openings 228A-B and a plurality of downstream openings 230. The upstream opening 228A may be sized to receive a second portion of the first cam shaft, for example. The upstream opening 228B and the plurality of downstream openings 230 may be sized to receive a second cam shaft (not shown). The solenoid valve 214 and the plurality of spark plug tubes 218 may be mounted to openings 232 formed adjacent to the cam bearing towers 220. An external wall 234 of the cylinder head 200, may be configured with an adequate surface area to receive a cam cover (not shown), which may be positioned above the cylinder head 200. When mounted to the cylinder head 200, the cam cover may be secured using a plurality of fasteners (not shown) that may be extended through a plurality of openings 236 formed on the external wall 234. Further, the external wall 234 of the cylinder head 200 may include a plurality of openings 238, formed adjacent to an inner edge of the wall.

In this way, the cylinder head 200, may include the cylinder head cap that may support the fuel pump for supplying fuel to engine cylinders. The fuel pump may be directly mounted to the cylinder head cap to simplify pump assembly while minimizing fuel leakage and addressing vibration issues.

Figure 3A:
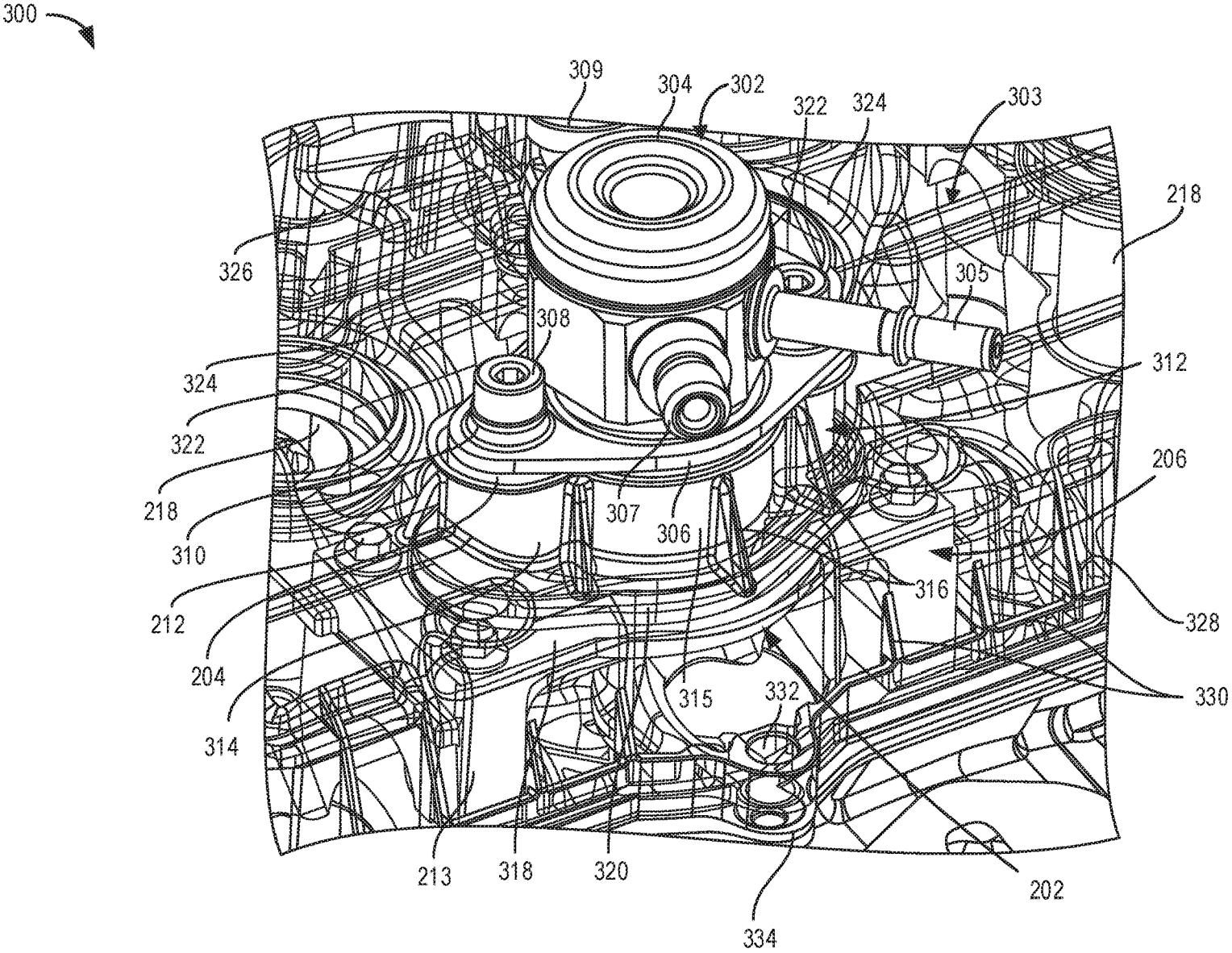
FIG. 3A shows a schematic depiction of a fuel pump mounted to the first embodiment of the cylinder head cap secured to the cylinder head.
Figure 3B:
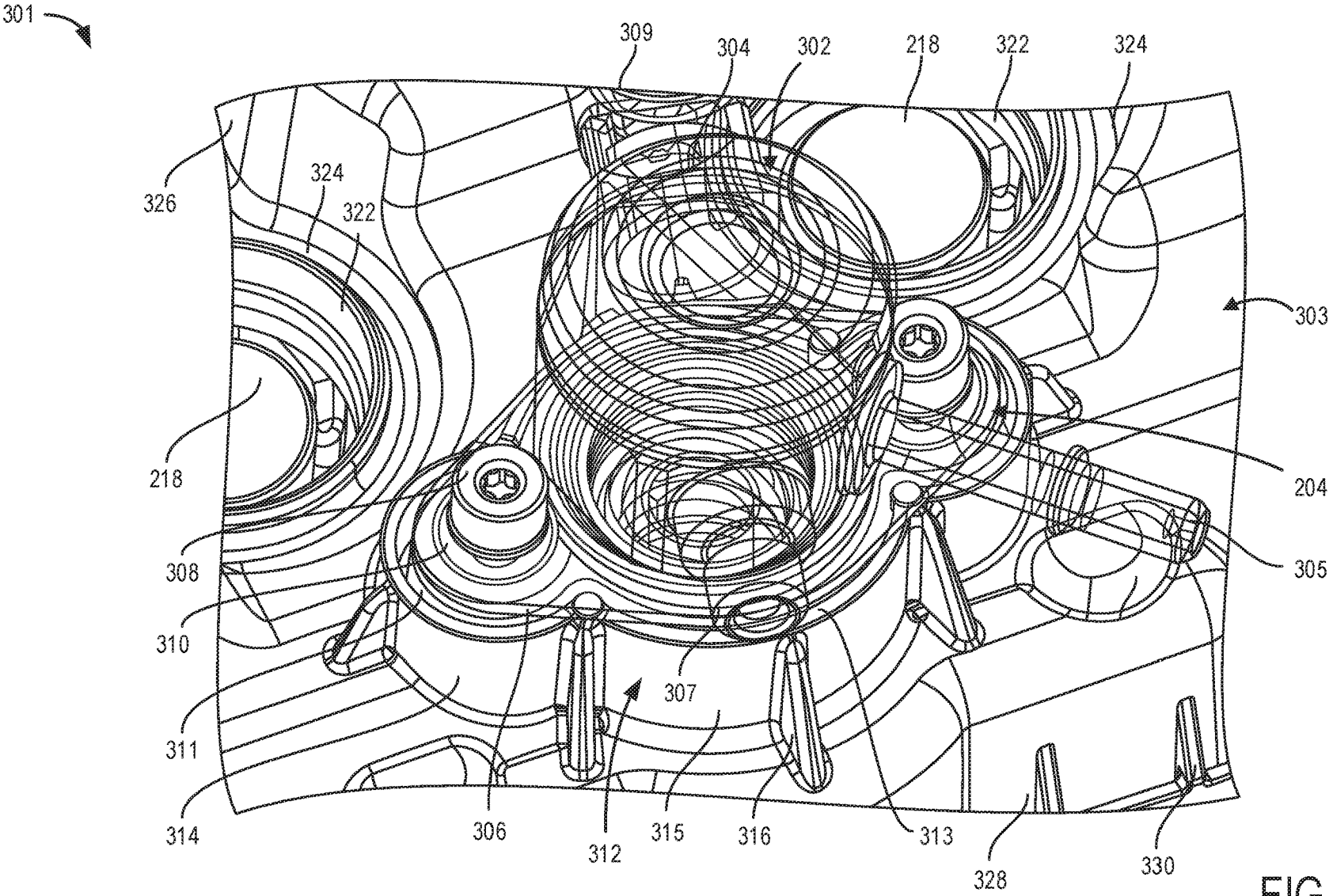
FIG. 3B shows a schematic depiction of the fuel pump mounted to the first embodiment of the cylinder head cap placed underneath a cam cover, and secured to the cylinder head.

Referring to FIGS. 3A-3B, a first view 300 and a second view 301 of a fuel pump 302 mounted to the cylinder head cap 202 positioned underneath a cam cover 303 is disclosed. The fuel pump 302 may include a body 304 having a plurality of pipes 305-309. The cylinder head cap 202 may be secured to the cylinder head 200 via the plurality of fasteners 212 extended through openings in each support member 213 of the cap. The cam cover 303 may be positioned over the cylinder head cap 202, with an enclosed portion 312 of the cam cover enclosing a raised portion 204 of the cylinder head cap. The enclosed portion 312 includes a plurality of outer enclosing sections 314 and an inner enclosing section 315, each outer enclosing section 314 connecting to the inner enclosing section 315 to form an opening to receive the raised portion 204 of the cylinder head cap 202. An external surface of the enclosed portion 312, may include a plurality of ribs 316 to provide structural support to the cam cover 303.

As shown in FIG. 3A, the fuel pump 302 may be mounted to the raised portion 204 of the cylinder head cap 202 enclosed within the enclosed portion 312. When mounted to the raised portion 204 of the cylinder head cap 202, a flange 306 of the fuel pump 302 may be in face-sharing contact with an outer surface (not shown) of the raised portion 204, with each flange boss 310 on the pump aligned with each cap mounting boss 311, as shown in FIG. 3B. Each cap mounting boss 311 may fit an opening in each outer enclosing section 314 of the enclosed portion 312, and an inner annular boss 313 of the raised portion 204 may fit inside the enclosing section 315 of the enclosed portion 312. A plurality of fasteners 308 may be used to secure the flange 306 of the fuel pump 302 to the raised portion 204 of the cylinder head cap 202. As an example, the fasteners 308 may be internal drive fasteners that may be extended through openings in each of the flange mounting bosses 310 and cap mounting bosses 311, to secure the fuel pump 302 to the cylinder head cap 202. A press-in-place gasket 320 may be positioned at a junction 318 between the raised portion 204 and lower portion 206 of the cylinder head cap 202. The cylinder head cap 202 may be comprised of a durable material that is designed to withstand engine vibration and corrosive effects of engine fluids. As an example, the cylinder head cap 202 may be comprised of ferrous or non-ferrous materials.

The cam cover 303 may include a plurality of openings 322 with an outer edge 324 that transitions to a raised portion 326 which may be at an upper level compared to the sloping edge. The plurality of openings 322 may be adequately sized to receive spark plug tubes 218, as shown in FIG. 3B. A side portion 328 of the cam cover 303 may include a plurality of ribs that provide structural support to the cam cover. The side portion 328 may also include a curved portion 332 having a slot 334. As an example, the curved portion 332 may be a convex shaped portion that forms a part of the side portion 328. The cam cover 303 may be comprised of a durable material that is designed to withstand engine vibration and corrosive effects of engine fluids. As an example, the cam cover 303 may be comprised of materials such as thermoset and thermoplastic elastomers that provide adequate sealing and vibration damping properties.

In this way, the fuel pump 302 may be adequately mounted to the cylinder head cap 202 secured to the cylinder head 200 via the plurality of fasteners 212. By directly mounting the fuel pump 302 to the cylinder head cap 202, the pump assembly may be simplified while minimizing fuel leakage and addressing vibration issues.

Figure 4:
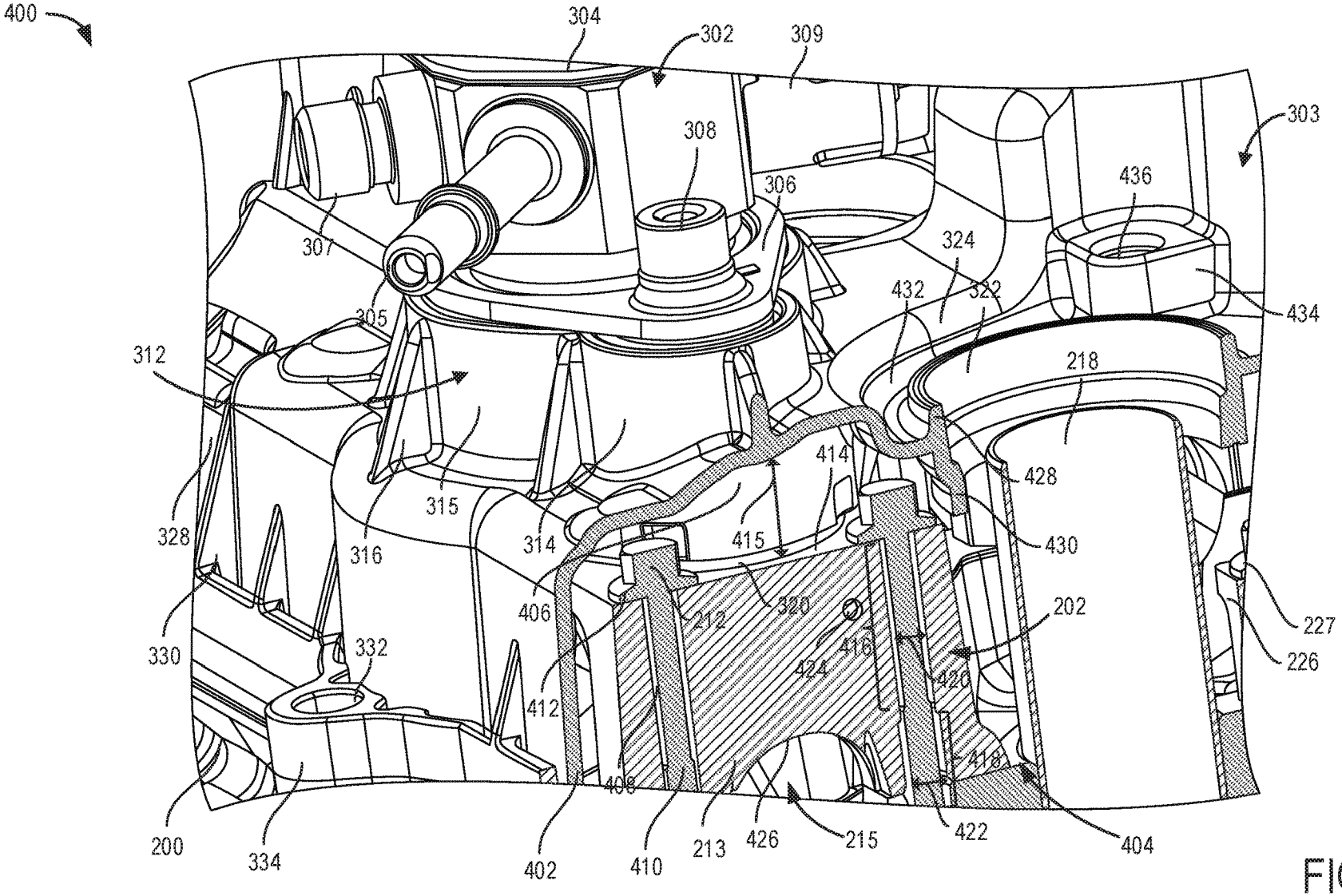
FIG. 4 shows a cross section view through a portion of the first embodiment of the cylinder head cap secured to the cylinder head.

Referring to FIG. 4, a cross section view 400 through the cam cover 303 and a portion of the first embodiment of the cylinder head cap 202 is disclosed. The cam cover 303 includes a lower extended portion 406 which encloses a section of the raised portion (e.g., raised portion 204 shown in FIG. 2) of the cylinder head cap 202. A portion of the cam cover 303 may be cut along a section 402, to expose an interior region 404 underneath the cover.

As shown in FIG. 4, the fuel pump 302 is mounted to the cylinder head cap 202, and secured in place using one or more fasteners 308. The enclosed portion 312 of the cam cover 303 encloses a topmost section of the raised portion (e.g., raised portion 204 shown in FIG. 3B), while the lower extended portion 406 encloses a remaining section of the raised portion. The lower extended portion 406 may also enclose the press-in-place gasket 320 mounted to a base region of the raised portion of the cylinder head cap 202. A clearance 415 may be provided between a top surface 414 of the support member 213 and an inner wall of the cam cover 303. The clearance 415 may be adequately sized to allow for adequate room for extending fasteners 212 through the support member 213. The cylinder head cap 202, may be secured to the cylinder head 200 by extending a linear portion 410 of each fastener 212 through each slot 408 formed in the support member 213. When secured to the cylinder head cap 202, a bolt cap 412 of each fastener 212 may be in face-sharing contact with a top surface 414 of the support member 213. Each fastener 212 may include a first section 416 having a first thickness 420 and a second section 418 having a second thickness 422. As an example, the fasteners 212 may be screws extended through the slots 408 in the support member 213 to secure the cylinder head cap 202 to the cylinder head 200. In alternative examples, bolts or other suitable means of mechanical assembly may be used to secure the cylinder head cap 202 to the cylinder head 200. The cylinder head cap 202 may include an internal slot 424 formed on the support member 213, and an arched surface 426 forming the opening 215 between the support member 213 and a bottom portion of the cylinder head 200.

The cam cover 303 may include the opening 322 and a side section 434 having a slot 436. The opening 322 may be adequately sized to receive the spark plug tube 218, for example. The opening 322 may include a first extended portion 428 and a second extended portion 430. As an example, the first extended portion 428 may extend upward and away from the recessed slot 432, while the second extended portion 430 may extend downward towards the interior region 404, underneath the cam cover 303. A recessed slot 432 may be formed between the outer edge 324 and the first extended portion 428 of the cam cover 303.

In this way, the fuel pump 302 may be mounted to the cylinder head cap 202 which is adequately secured to the cylinder head 200 using the plurality of fasteners 212 extended through the support member 213 of the cap. Subsequently, the cam cover 303 may be secured over the cylinder head cap 202 to enclose the cap.

Figure 5:
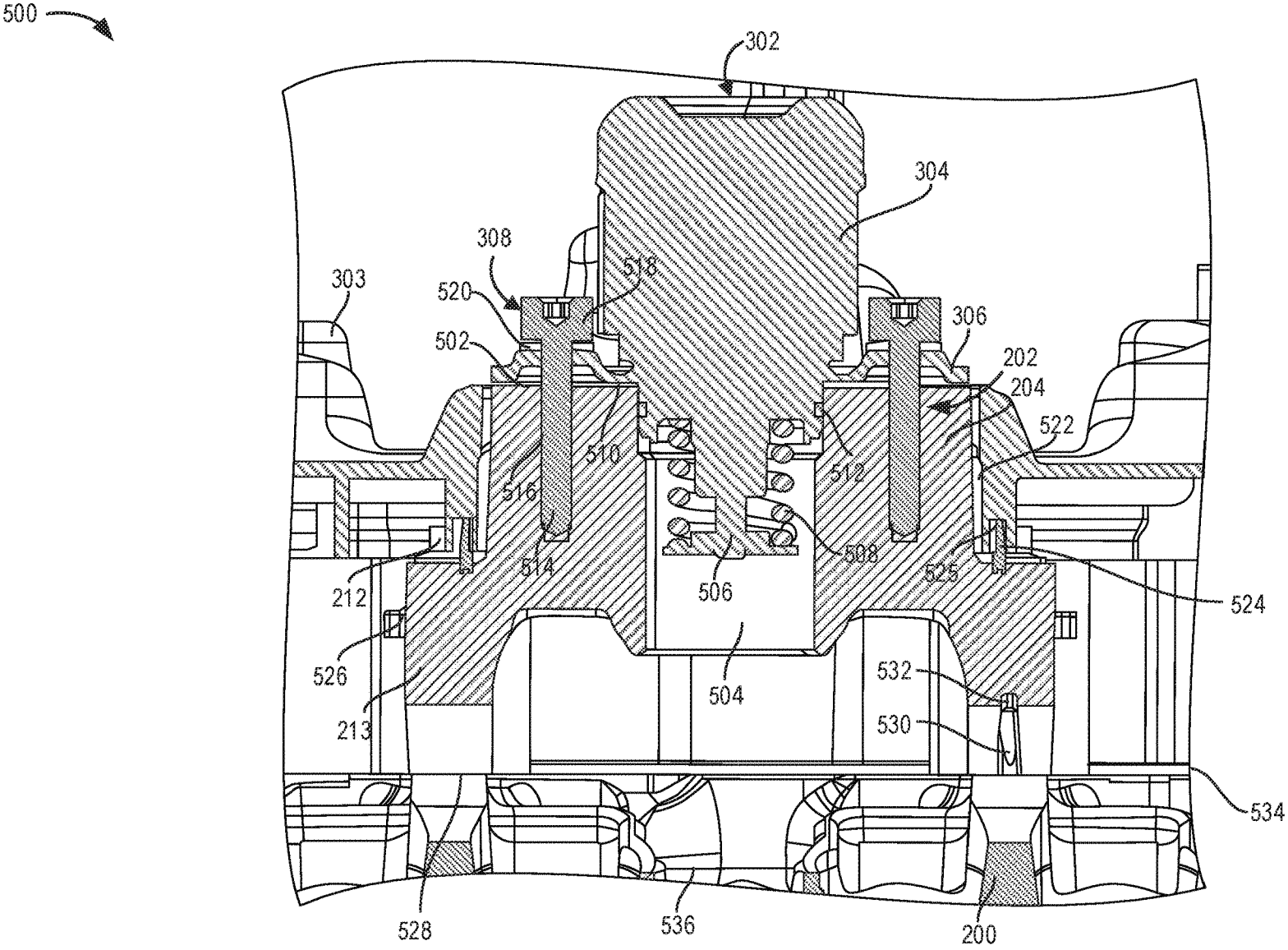
FIG. 5 shows a cross section view through the fuel pump mounted to the first embodiment of the cylinder head cap secured to the cylinder head.

Referring to FIG. 5, a cross section view 500 through the fuel pump 302 mounted to the first embodiment of the cylinder head cap 202 is disclosed. The fuel pump 302 is mounted to the cylinder head cap 202, with a ram 506 of the pump disposed in a main opening 504 in the cap. The ram 506 may be enclosed by a plurality of compression springs 507.

As shown in FIG. 5, the fuel pump 302 is directly mounted to the cylinder head cap 202. When mounted to the cylinder head cap 202, the flange 306 of the fuel pump 302 may be in face-sharing contact with an inner surface 502 of the cap along contact interface 510, creating a seal between the flange and cap via compression. The ram 506 of the fuel pump 302 may be disposed inside the main opening 504, with an external portion of the ram making face contact with a periphery of the main opening 504 along contact interface 512. The fuel pump 302 may be secured to the cylinder head cap 202 via the plurality of fasteners 308, positioned on either side of the pump. As an example, a rod-like portion 514 of each fastener 308 may be extended into a slot 516, formed in the cylinder head cap, to secure the fuel pump 302 to the cap. When secured, a washer 520 extended through the rod-like portion 514 of each fastener 308, may be positioned between the flange 306 and a head cap 518 of the fastener. In this case, the washer 520 may be in face-sharing contact with a portion of the flange 306. A greater portion of the body 304 of the fuel pump 302 may remain above the cam cover 303, when the pump is mounted to the cylinder head cap 202. A plurality of dowels 524, extended through slots 525 in each support member 213, may provide a means of securing the cam cover 303 to the cylinder head cap 302.

When mounted to the cylinder head 200, the cylinder head cap 302 may be secured using the plurality of fasteners 212 extended through each support member 213 of the cap. The raised portion 204 of the cylinder head cap 302 may fit in an interior region underneath the cam cover 303, forming a side opening 522 between the cap and cover. When mounted to the cylinder head 200, a bottom portion of each support member 213 of the cylinder head cap 202 may be in face-sharing contact with a portion of the cylinder head along contact interface 528. A plurality of protruding portions 526 formed on each support member 213 of the cylinder head cap 202, may be enclosed within an interior region between the cap and internal walls of the cam cover 303. A rod 530 may be inserted into an aperture 532, formed on one of the support members 213, to provide additional means of securing the cylinder head cap 202 to the cylinder head 200. The cylinder head cap 202 and cam cover 303 may extend to a level 534, when mounted to the cylinder head 200. The cylinder head 200 may include an interior region 536, formed below the level 534.

In this way, the fuel pump 302 may be directly mounted to the cylinder head cap 202 secured to the cylinder head 200 via the plurality of the fasteners 212. By directly mounting the fuel pump 302 to the cylinder head cap 202, a number of assembly components may be reduced to simplify pump assembly while minimizing fuel leakage and addressing vibration issues.

Referring to FIG. 6, a schematic depiction of the fuel pump 302 mounted to the first embodiment of the cylinder head cap 202 secured to the cylinder head 200, with the cam cover removed, is disclosed. The cylinder head 200 includes the external wall 234 configured with openings 236 to receive a plurality of fasteners (not shown) for securing the cam cover to the cylinder head. The external wall 234 may also include openings 238, formed adjacent to an inner edge of the wall. The interior region 536 of the cylinder head 200 may include a plurality of apertures 614 to receive engine components such as a valve train tappet, spring and valve guide. A plurality of cam caps 226 may be secured to a portion of the cam bearing towers 220 via the plurality of fasteners 227. Also, the spark plug tubes 218 may be mounted in openings 233 formed adjacent to the cam bearing towers 220.

As shown in FIG. 6, the cylinder head cap 202 may be mounted to the cylinder head 200 via the plurality of fasteners 212 extended through each support member 213. The flange 306 of the fuel pump 302 may be secured to the raised portion 204 of the cylinder head cap 202 via the plurality of fasteners 308. The raised portion 204 may include the cap mounting bosses 311 and inner annular boss 313 of cylinder head cap 302. The cap mounting bosses 311 may connect to the inner annular boss 313 at a junction 602, forming the raised portion 204 of the cylinder head cap 202. The cap mounting bosses 311 and inner annular boss 313 may be cylindrically shaped, with each cap mounting boss 311 having a smaller size compared to the inner annular boss 313. In alternative examples, the each cap mounting boss 311 and inner annular boss 313, may have other shapes or may be configured with similar sizes. When mounted to the cylinder cap 202, the flange 306 of the fuel pump 302 may be in face-sharing contact with a top surface (not shown) of each cap mounting boss 311 and inner annular boss 313.

The press-in-place gasket 320 may be positioned in a recessed slot (not shown) formed on the inner surface 502 of the cylinder head cap 202. The press-in-place gasket 320 may have an oval shape that may be configured to fit around a base region adjacent to each cap mounting boss 311 and the inner annular boss 313. In alternative embodiments, the press-in-place gasket 320 may be positioned in a recessed groove formed in an interior region of the cam cover (e.g., cam cover 303 shown in FIG. 4) to minimize slippage of the gasket, and to provide a tight seal between the fuel pump, cap and cam cover. The press-in-place gasket 320 may be comprised of an elastomeric material such as ASTM D2000 AEM, ACM, HNBR, fluorinated elastomers, silicon, and room temperature vulcanized rubber. The lower portion 206 of the cylinder head cap 202 may include a side portion having linear sections 606 and a curved section 608. Each linear section 606 may connect to the curved section 608 at a junction 610. As an example, the curved section 608 may be circular in shape, although other shapes may be possible. Further, each linear section 606 may connect to the support member 213 via a curved junction 612.

Referring to FIG. 7, a cross sectional view 700 of the first embodiment of the cylinder head cap 202 and the cam cover 303 secured to the cylinder head 200, is disclosed. The cross sectional view 700 shows the cylinder head cap 202 with a top section of the fuel pump removed. The cylinder head 200 may include components 746-748, solenoid valve 216 with a plug 750, and an interior wall 752. As an example, components 746-748 may include a valve train tappet, valves, valve guide and spring.

As shown in FIG. 7, the press-in-place gasket 320 on cylinder head cap 202, may be positioned in a recessed slot 702 formed between an inner portion 704 and outer portion 706 of the cam cover 303. As an example, the inner portion 704 and outer portion 706 may have oval shapes similar to that of the press-in-place gasket 320. The outer portion 706 may include a plurality of curved sections 708 formed at each end of the outer portion. As example, each curved section 708 may be concavely shaped to fit a portion of the bolt cap 412 of the each fastener 212.

The cap mounting bosses 311 and inner annular boss 313 of the cylinder head cap 202 may be enclosed within the inner portion 704. Each cap mounting boss 311 may be secured to a flange portion (e.g., flange portion 306 as shown in FIG. 5) of the fuel pump via a fastener (e.g., fastener 308 as shown in FIG. 5) having the rod-like portion 514. When mounted to the cylinder head 202, the ram 506 of the fuel pump may be disposed in the main opening 504 formed in the inner annular boss 313. A slot 710 may be formed at the periphery of the main opening 504. The slot 710 may form part of an oil feed gallery that connects to the valve train tappet.

The cam cover 303 may include a first wall portion 712, a second wall portion 714, a third wall portion 716 and a fourth wall portion 718. The first wall portion 712 may include linear sections 720-726 and curved sections 728-730. A curved junction 732 may connect linear sections 720 and 722 together. Each linear section 722 and 724 may be connected to the curved section 726 at a junction 734. The second wall portion 714, third wall portion 716 and fourth wall portion 718 may connect to one or more of the openings 322. Each opening 322 may be adequately sized to receive an outer casing 738 that encloses the spark plug tubes 218 containing spark plugs 744. A portion of each outer casing 738, may be in face-sharing contact with an internal surface of each opening 322. The cam cover 303 may also include a side portion 740 having an opening 742.

Figure 8:
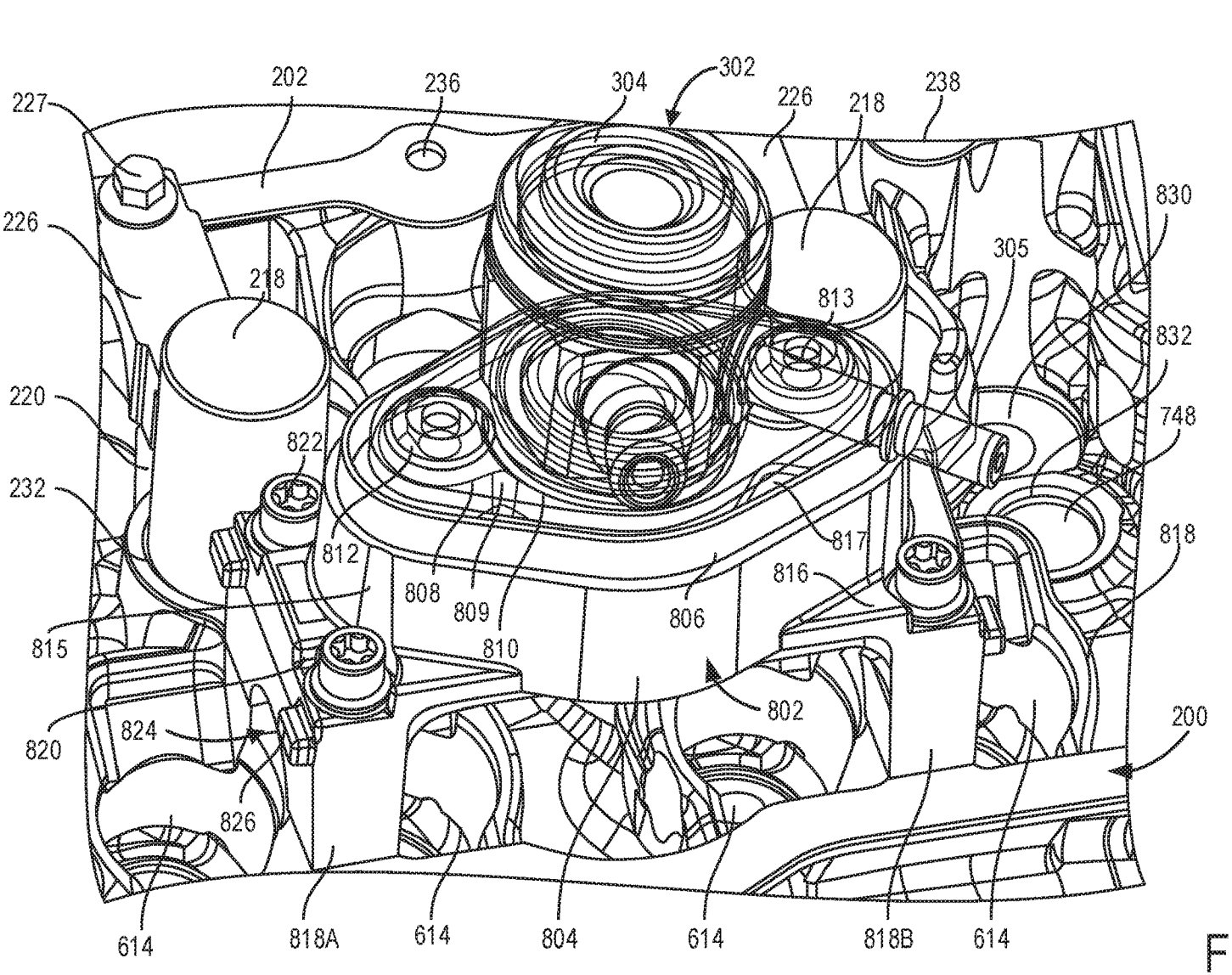
FIG. 8 shows a schematic depiction of the fuel pump mounted to a second embodiment of a cylinder head cap secured to the cylinder head, with a cam cover removed.

Referring to FIG. 8, a schematic depiction 800 of the fuel pump 302 mounted to a second embodiment of a cylinder head cap 802 secured to the cylinder head 200, is disclosed. The cylinder head cap 802 may include a top section, middle section and a bottom section. The top section may include cap mounting bosses 808 and an annular boss 810. The middle section may include a curved middle portion 814, and the bottom section includes a cross member 816 and support members 818A-818B. The cylinder head 200 includes the external wall 234 configured with openings 236 to receive a plurality of fasteners (not shown) for securing a cam cover to the cylinder head. The external wall 234 may also include openings 238, formed adjacent to an inner edge of the wall. The interior region 536 of the cylinder head 200 may include a plurality of apertures 614, openings 830 and sand core hole 832. The opening 830 may be adequately sized to receive a cylinder head bolt to attach the cylinder head to an engine block. The sand core hole 832 may be plugged with a cap. The plurality of cam caps 226 may be used to secure a cam shaft (not shown) to the cam bearing towers 220 via the plurality of fasteners 227. Further, the spark plug tubes 218 may be mounted in openings 232 formed adjacent to the cam bearing towers 220.

The flange 306 of the fuel pump 302 may be secured to the cap mounting bosses 808 on the cylinder head cap 802 via a plurality of fasteners (not shown) that may extended through openings 813 formed through the flange bosses 812. When mounted, a portion of the fuel pump 302 may extend through a main opening (not shown) formed in the annular boss 810 of the cylinder head cap 802. Each cap mounting boss 808 may connect to the annular boss 810 at a junction 809 to form the top section of the cylinder head cap 802. The cap mounting bosses 808 and annular boss 810 may be cylindrical shaped, with each cap mounting boss 808 having a smaller size compared to the annular boss 810. In alternative examples, each cap mounting boss 808 and annular boss 810, may have other shapes or may be configured with similar sizes. When the fuel pump 302 is mounted to the cylinder cap 802, the flange 306 may be in face-sharing contact with a top surface (not shown) of each cap mounting boss 808 and annular boss 810.

A press-in-place gasket 806 may be positioned within a recessed slot (not shown) formed on a top surface of the curved middle portion 814 of the cylinder head cap 802. The press-in-place gasket 806 may have an oval shape that may be configured to fit around a base region adjacent to each cap mounting boss 808 and the annular boss 810. In other embodiments, the press-in-place gasket 806 may be positioned in a recessed groove formed on a cam cover secured over the cylinder head cap 802 and cylinder head. In this way, the press-in-place gasket 806 may provide a tight seal between the fuel pump 302, cylinder head cap 802 and cam cover. The press-in-place gasket 806 may be comprised of an elastomeric material such as ASTM D2000 AEM, ACM, HNBR, fluorinated elastomers, silicon, and room temperature vulcanized rubber (RTV). When the press-in-place gasket 806 is secured in place, an enclosed region 817 may be formed between the gasket, and each cap mounting boss 808 and annular boss 810.

The curved middle portion 814 of the cylinder head cap 802 may connect to the cross member 816 that connects to each support member 818A-818B. The curved middle portion 814 may include a plurality of recessed sections 815 formed on an external surface adjacent to the fasteners 822. A plurality of recessed seats 820 may be formed on a top portion of each support member 818A-818B, at a location adjacent to each recessed section 815. Each recessed seat 820 may have an opening (not shown), that extends through each support member 818A-818B, and each opening may be sized to receive the fastener 822. Each recessed seat 820 may be adequately sized to receive a head cap of each fastener 822 as disclosed further with reference to FIG. 9. In this way, the cylinder head cap 802 may be adequately secured to the cylinder head 200 via the plurality of fasteners 822 extended through each support member 818 of the cylinder head cap.

Figure 9:
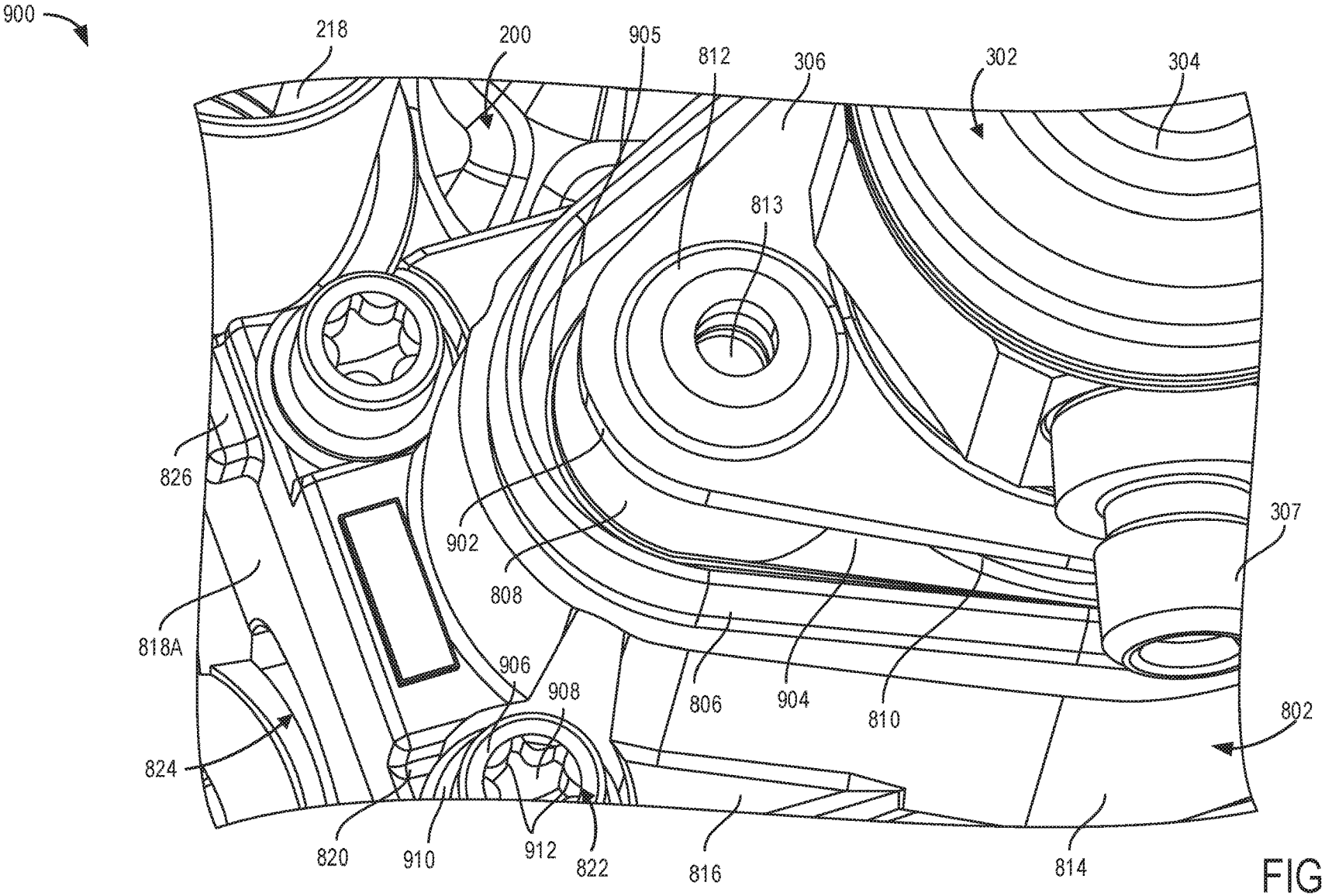
FIG. 9 shows a schematic depiction of the fuel pump mounted to the second embodiment of the cylinder head cap, with a press-in-place gasket secured to the cap.

Referring to FIG. 9, an alternative view 900 of the fuel pump 302 mounted to the second embodiment of the cylinder head cap 802 showing details of the press-in-place gasket 806 and fasteners 822 on the cylinder head cap is disclosed.

As shown in FIG. 9, the fuel pump 302 may be mounted to the cylinder head cap 802, with a curved section 902 of the flange 306 aligned with the cap mounting boss 808. When aligned, the flange boss 812 on the flange 306 may be positioned above the cap mounting boss 808, forming the opening 813 that may be sized to receive a fastener for securing the fuel pump 302 to the cylinder head cap 802. A clearance 904 may be formed between the flange 306 and outer surface 905 on the cylinder head cap 802. The press-in-place gasket 806 may be positioned within a recessed slot (not shown) formed at the periphery of the outer surface 905. As an example, the press-in-place gasket 806 may be secured to the cylinder head cap 802 to provide a tight seal, thereby minimizing leakage in the pump assembly.

The cylinder head cap 802 may be secured to the cylinder head 200 using the plurality of fasteners 822 positioned in the recessed seats 820 formed on the support member 818A. Each fastener 822 may include a head cap 906 having a recessed aperture 908 and an outer ring 910. The aperture 908 may include a plurality of protrusions 912 which may be spaced apart to form a plurality of grooves 914. As an example, the aperture 908 may be adequately sized to receive a tool for adjusting the fastener 822, with the protrusions 912 providing grip to the tool. When secured to the cylinder head cap 802, the outer ring 910 of each fastener 822 may be in face-sharing contact with a portion of each recessed seat 820, thereby forming a tight seal between the fastener and cylinder head cap. In this way, the cylinder head cap 802 may be adequately secured to the cylinder head 200 via the plurality of fasteners 822, and the fuel pump 302 may be directly secured to the cylinder head cap 802 to minimize fuel leakage while addressing vibration issues.

Figure 10A:
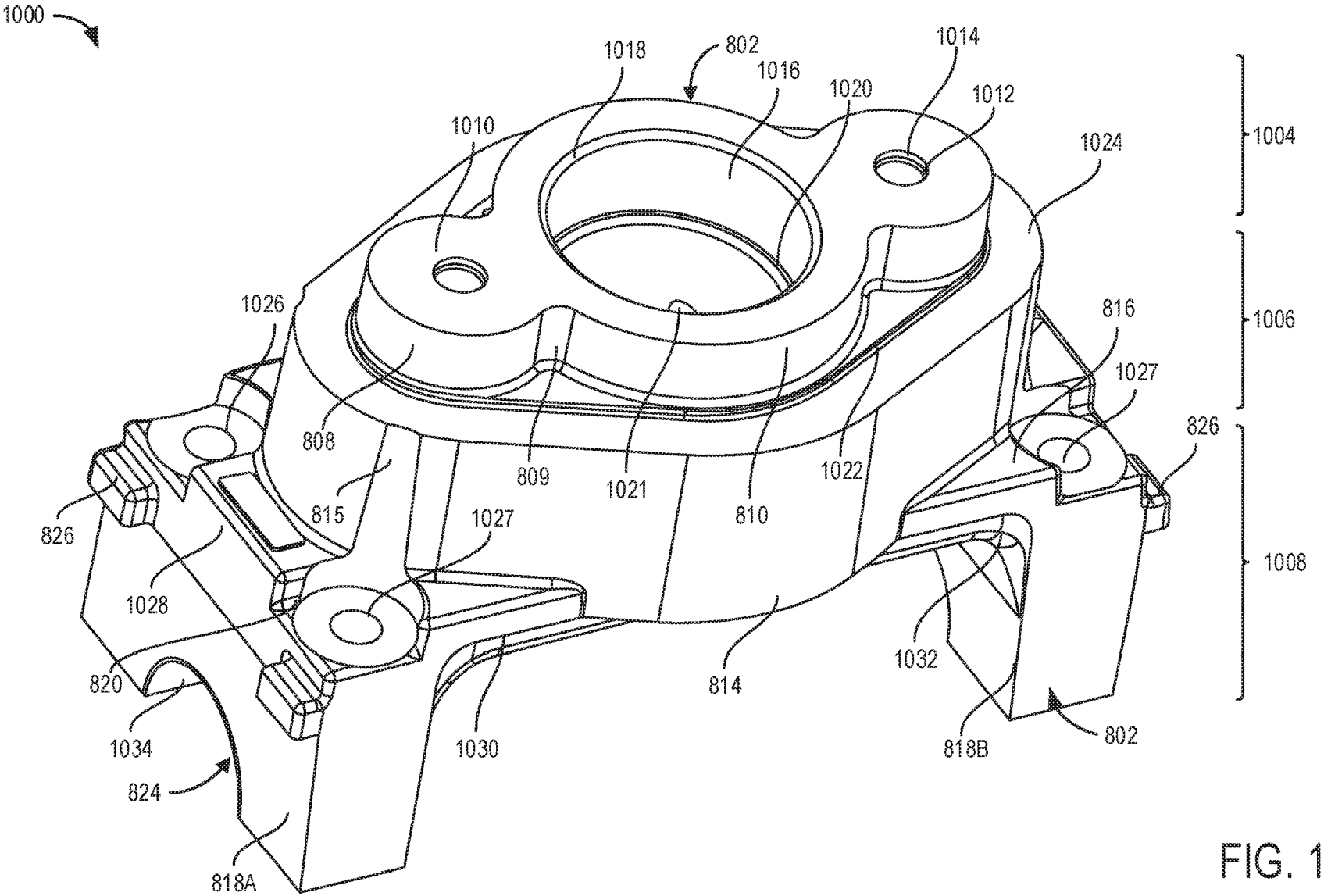
FIG. 10A shows a first view of the second embodiment of the cylinder head cap.
Figure 10B:
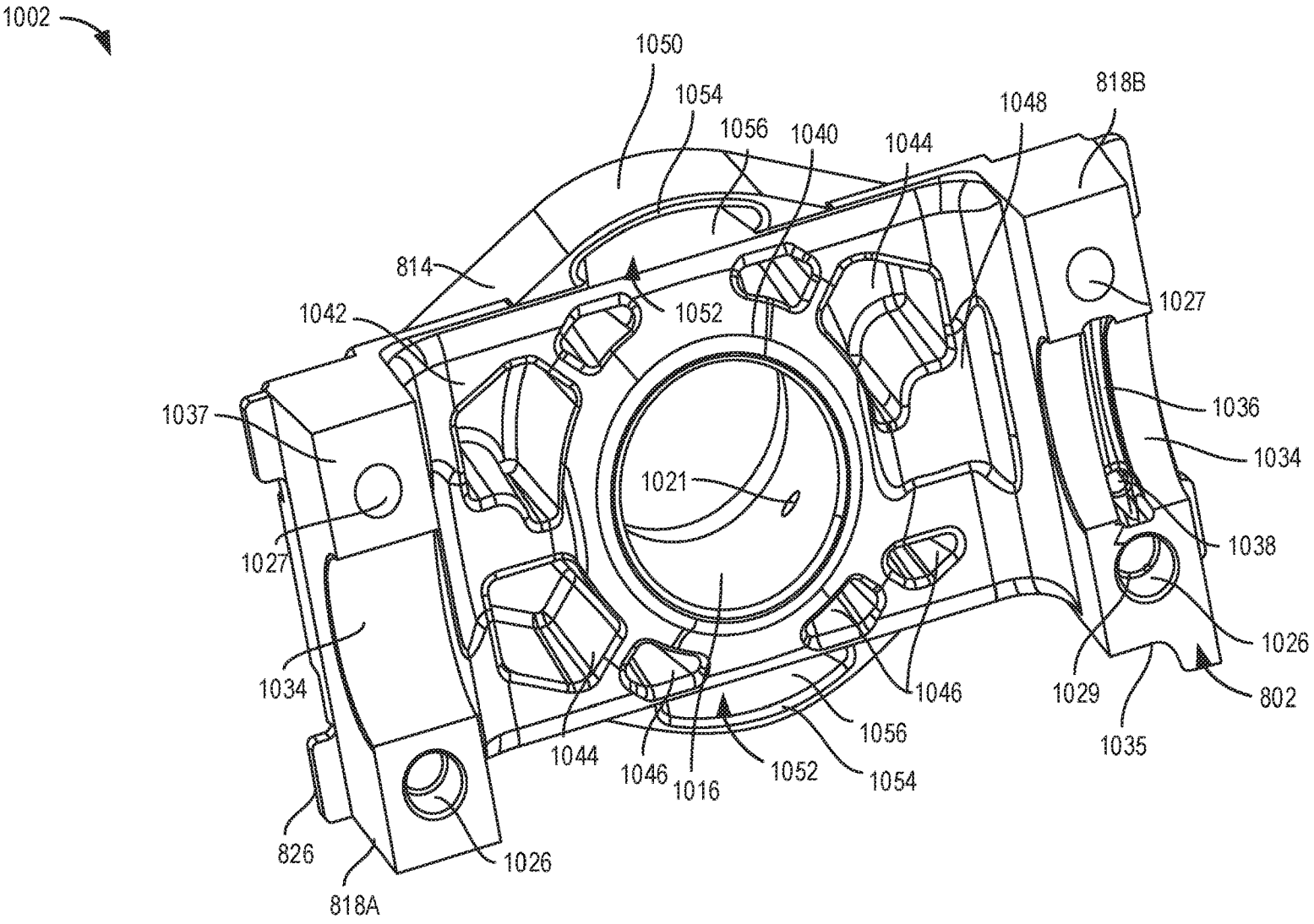
FIG. 10B shows a second view of the second embodiment of the cylinder head cap.

Referring to FIGS. 10A-10B, a first view 1000 and a second view 1002, respectively of the second embodiment of the cylinder head cap 802 is disclosed. The cylinder head cap 802 includes an upper section 1004, a middle section 1006 and a lower section 1008. The upper section 1004, may include the cap mounting bosses 808 and annular boss 810 of the cylinder head cap 802. The middle section 1006 forms a greater portion of the curved middle portion 814. The upper section 1004 and middle section 1006 may form a raised portion of the cylinder head cap 802. The lower section 1008 includes a part of the curved middle portion 814, cross member 816 and support members 818A-818B. The lower section 1008 may form a lower portion of the cylindrical head cap 802. The upper section 1004 is connected to the middle section 1006, which in turn is connected to the lower section 1008 to form a single integral cap for mounting the fuel pump to the cylinder head.

As shown in FIG. 10A, each cap mounting boss 808 is connected to the annular boss 810 at the junction 809 to form the upper section 1004 of the cylinder head cap 802. Further, the cap mounting bosses 808 may be connected to the annular boss 810 to form an upstream face 1010 that may be in face-sharing contact with a portion of the fuel pump, such as the flange 306 of the fuel pump 302 shown in FIGS. 8-9. Each cap mounting boss 808 includes a slot 1012 to receive a fastener, such as a fastener 308 shown in FIG. 6. Each slot 1012 may include internal threads 1014 that mate with a portion of the fastener. As an example, each slot 1012 may be adequately sized to receive a bolt or screw to secure the fuel pump 302 to the cylinder head cap 802. Each cap mounting boss 808 may be configured with a cylindrical shape, for example. In alternative examples, each cap mounting boss 808 may have other shapes. The annular boss 810 may include a main opening 1016 having a beveled edge 1018, an internal lining 1020 and an aperture 1021. As an example, the opening 1016 may be adequately sized to receive a portion of the fuel pump, such as a ram of the pump as disclosed further below with reference to FIG. 12. The annular boss 810 may have a cylindrical shape, although other shapes are possible. When mounted to the cylinder head cap 802, an external portion of the fuel pump may seat on the beveled edge 1018 of the main opening 1016, and the ram of the pump may be disposed inside the main opening 1016.

A recessed slot 1022 may be formed around an outer surface 1024 of the curved middle portion 814 of the cylinder head cap 802. The recessed slot 1022 may be adequately sized to receive a sealing gasket, such as the press-in-place gasket 806 shown in FIGS. 8-9. When installed in the recessed slot 1022, the sealing gasket may enclose the upper section 1004 of the cylinder head cap 802, and may provide a tight seal on the cylinder head cap. The curved middle portion 814 of the cylinder head cap 802 may extend downward to connect with the cross member 816, for example. The cross member 816 may include a side section that transitions into each support member 818 at curved junctions 1032. The recessed sections 815, formed on an external surface of the curved middle portion 814, extend into the recessed seats 820 formed on each support member 818A-818B. Each recessed seat 820 is configured with an opening 1026 to receive a fastener (such as fastener 822 shown in FIG. 9) to secure the cylinder head cap 802 to a cylinder head. The recessed seats on each support member 818A-818B may be separated by a raised section 1028 on the cross member 816, for example.

Each support member 818, may include a plurality of protrusions 826 and an arched opening 824. The plurality of protrusions 826 may be formed on a side portion of each support member 818A-818B. The arched opening 824, formed in a middle region of each support member 818A-818B, may include a wall 1034 that extends through the support member as shown in FIG. 10B. As an example, the opening arched 824 may be semi-circular in shape, and may be sized to receive a portion of a camshaft (not shown).

As shown in FIG. 10B, the support member 818B may include a recessed aperture 1036 having an internal slot 1038. The internal slot 1038 may be adequately sized to receive a dowel (such as rod 530 shown in FIG. 5) to provide additional means of securing the cylinder head cap 802 to the cylinder head. Further, support member 818B may include a curved portion 1035. The openings 1026-1027 formed on each support member 818A-818B, may extend from the recessed seat to an inner surface 1037. Each opening 1027 may include an internal circular ring 1029. As an example, each opening 1026 may be sized with a first diameter smaller than a second diameter of each opening 1027. In another example, openings 1026 and 1027 may have the same diameter, to receive fasteners of a single size that may be used to secure the cylinder head cap 802 to the cylinder head. The main opening 1016 may extend from the upper section 1004 of the cylinder head cap 802 to an inner surface 1042 of the cross member 816. The inner surface 1042 of the cross member 816 may include a sloping portion 1040, a plurality of primary apertures 1044 and secondary apertures 1046, and a recessed section 1048. The sloping portion 1040 may slope towards the periphery of the main opening 1016. The primary apertures 1044 may be formed adjacent to each support member 818A-818B, while secondary apertures 1046 may be formed in a middle region of the cross member 816, adjacent to the primary apertures 1044. The primary apertures 1044 may be larger than the secondary apertures 1046, for example. Both the primary and secondary apertures may extend from the inner surface 1042 inward towards an interior portion of the cross member 816. Each curved section 1050 of the cylinder head cap 802 may include a recessed aperture 1052 formed between a rib section 1054 and an internal wall 1056. The recessed aperture 1052 may extend inward into an interior region of the curved middle portion 814. As an example, the primary apertures 1044, secondary apertures 1046 and recessed apertures 1052 may be formed to reduce weight of the cylinder head cap 802.

Figure 11:
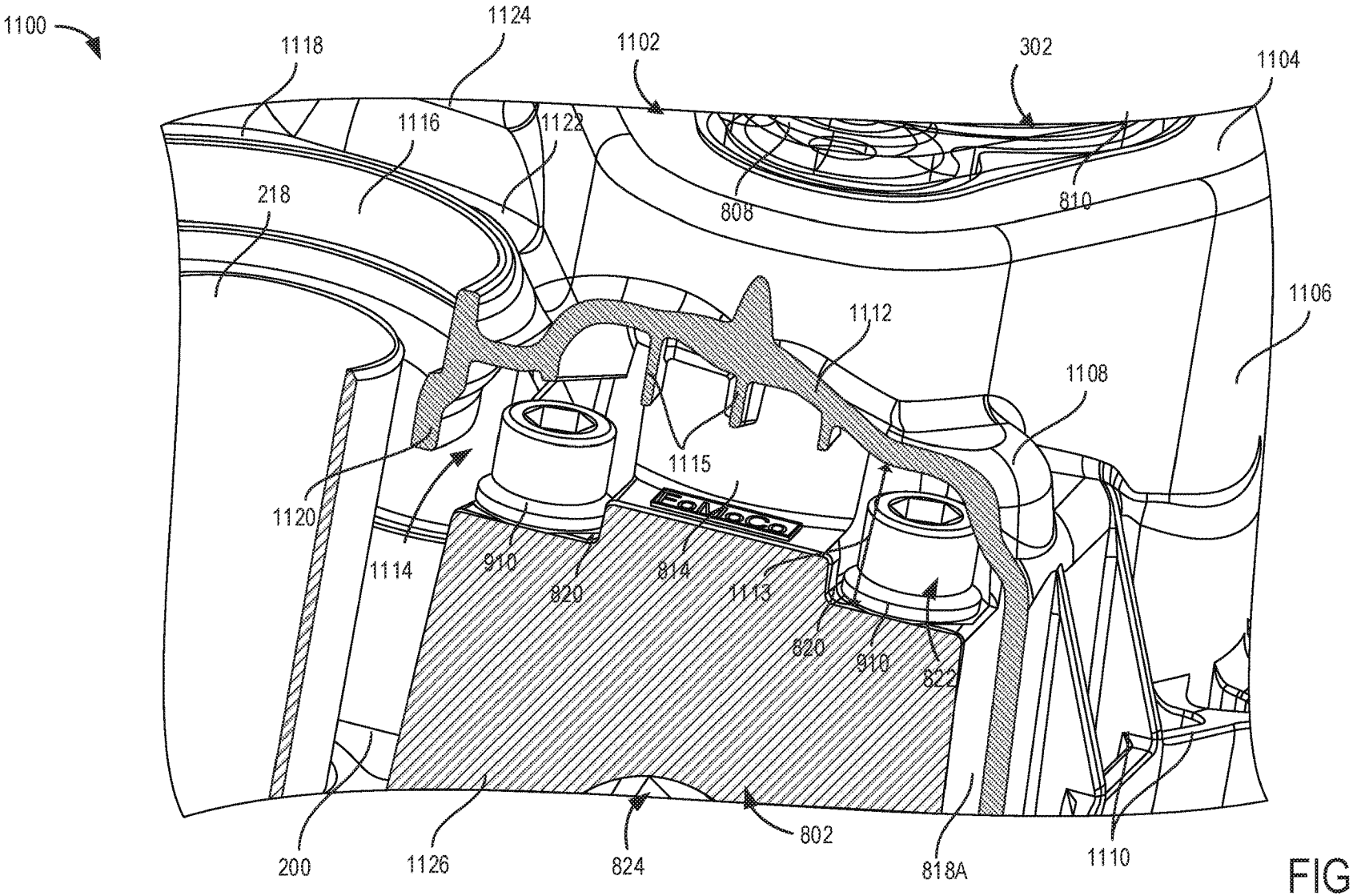
FIG. 11 shows a cross section view through the cam cover and a portion of the second embodiment of the cylinder head cap secured to the cylinder head.

Referring to FIG. 11, a cross section view 1100 through a cam cover 1102 and a portion of the second embodiment of the cylinder head cap 802 is disclosed. The cam cover 1102 includes a top portion 1104, and a lower extended portion 1106 which encloses the top and middle sections of the cylinder head cap 802. The lower extended portion 1106 may include a curved portion 1108, and a plurality of ribs 1110 to strengthen the cam cover 1102. When the cam cover 1102 is cut along a wall section 1112, an interior region 1114 underneath the cam cover is exposed. A plurality of internal ribs 1115 formed on the cam cover 1102, may provide additional structural integrity to the cover.

As shown in FIG. 11, the fuel pump 302 is mounted to the cap mounting boss 808 and annular boss 810 of the cylinder head cap 802, and may be secured in place using fasteners, such as fastener 308 shown in FIG. 4. The lower extended portion 1106 encloses the top and middle portions of the cylinder head cap 802. Although not shown, the lower extended portion 1106 also encloses a sealing gasket (e.g., press-in-place gasket 320 shown in FIG. 8) mounted at an interface between the top and middle sections of the cylinder head cap 802, for example. In other embodiments, the sealing gasket may be positioned in a recessed groove (not shown) formed in an interior region of the cam cover 1102. The cam cover 1102 may include compression tabs, wherein each compression tab has a height that controls compression of the sealing gasket mounted to the cam cover. In this way, the sealing gasket may provide a tight seal between the fuel pump 302, cylinder head cap 802 and cam cover 1102. The cylinder head cap 802, may be secured to the cylinder head 200 using the plurality of fasteners 822 extended through slots formed on support member 818A. A clearance 1113 may be provided between an internal wall of the cam cover 1102 and the recessed seat 820 of the cylinder head cap 802. The clearance 1113 may be adequately sized to provide adequate space for tightening each fastener 822 to the recessed seat 820 on the cap. When secured to cylinder head cap 802, the outer ring 910 of each fastener 822 may be in face-sharing contact with the recessed seat 820. As an example, the fasteners 822 may be bolts or screws extended through the openings in the support member 818A to secure the cylinder head cap 802 to the cylinder head 200. In alternative examples, other suitable means of mechanical assembly may be used to secure the cylinder head cap 802 to the cylinder head 200. The cylinder head cap 802 may include the arched 824 formed through a side section 1126 of support member 818A.

The cam cover 1102 includes an opening 1116 formed adjacent to the lower extended portion 1106. The opening 1116 may be adequately sized to receive the spark plug tube 218, for example. The opening 322 may include an upward extending portion 1118 and a downward extending portion 1120. As an example, the upward extending portion 428 may extended upward and away from the opening 1116, while the downward extending portion 1120 may extend downward towards the interior region 1114 underneath the cam cover 1102. A recessed slot 1122 may be formed between an outer edge 1124 and upward extending portion 1118.

In this way, the fuel pump 302 may be directly mounted to the cylinder head cap 802 and adequately secured to the cylinder head 200 using the plurality of fasteners 822 extended through the support member 818A of the cap. Subsequently, the cam cover 1102 may be secured over the cylinder head 200 to enclose the cylinder head cap and provide openings for spark plug tubes.

Referring to FIG. 12, a cross section view 1200 through the fuel pump 302 mounted to an alternative embodiment of a cylinder head cap 1202 is disclosed. The fuel pump 302 is mounted to the cylinder head cap 1202, with a ram 506 of the pump disposed in the opening 1207 in the cap. The fuel pump 302 may include a plurality of springs 508 configured to enclose the ram 506.

As shown in FIG. 12, the flange 306 of the fuel pump 302 is directly mounted to the cylinder head cap 1202. In this case, the flange 306 of the fuel pump 302 may be positioned above an outer surface 1203 of the cam cover 1102. When mounted to the cylinder head cap 1202, the flange 306 of the fuel pump 302 may be in face-sharing contact with an inner surface 1208 of the cap along contact interface 1210, creating a seal between the flange and cap via compression. The ram 506 of the fuel pump 302 may be disposed inside the opening 1207, with an external portion of the ram making face contact with a periphery of the opening along contact interface 1212. The fuel pump 302 may be disposed in the opening 1207 to deliver fuel to cylinders mounted in a cylinder block secured to the cylinder head 200. The fuel pump 302 may be secured to the cylindrical head cap 1202 via a plurality of fasteners (such as fasteners 308 shown in FIG. 5), positioned on either side of the pump. As an example, each fastener may extend into a slot formed in the flange 306 and cylinder head cap 1202, to secure the fuel pump 302 in place. A greater portion of the body 304 of the fuel pump 302, including pipes 305-307, may remain above the cam cover 1102, when the fuel pump is mounted to the cylinder head cap 1202. In this example, the cam cover 1102 may be secured to the cylinder head cap 1202 using a plurality of dowels 1204 attached to the cap. The dowels 1204 may be extended into slots 1205 formed in the cam cover 1102, to secure the cylinder head cap 1202 to the cover. In other examples, a single dowel attached to the cylinder head 200, may be extended into a slot (e.g., slot 1038 shown in FIG. 10B) in a support member of the cap (e.g., support member 818B shown in FIG. 8) to secure the cover to the cap. The flange 306 may close an opening 1206 formed between the cam cover 1102 and cylinder head cap 1202, to provide a tight seal between the fuel pump 302, cylinder head cap and cam cover. Although not shown, a press-in-place gasket may be secured within either a recessed slot formed on the cylinder head cap 1202 or a recessed groove formed in an interior region of the cam cover 1102 to provide a tight seal between the fuel pump, cap and cam cover.

When the cam cover 1102 is mounted to the cylinder head cap 1202, a clearance 1214 may be formed between the cap and an inner surface 1215 of the cover. The cylinder head cap 1202 may include a plurality of recessed apertures 1216. The cam cover 1102 may be secured to the cylinder head 200 via a fastener 1218 extended through a slot 1220 formed in the cover. When secured to the cam cover 1102, a head cap 1222 of the fastener 1218 may be in face-sharing contact with the cover, forming a tightly coupling that provides an adequately means of securing the cover to the cylinder head. The cam cover 1102 may include separating walls 1224 and 1226 that form a first enclosed region 1228. A second enclosed region 1234 may be formed between the separating wall 1226, internal wall 1230 and an external wall 1232. As an example, the second enclosed region 1234 may be adequately sized to enclose an engine component 1236.

In this way, the fuel pump 302 may be directly mounted to the cylinder head cap 1202 secured to the cylinder head 200 via the one or more fasteners. By directly mounting the fuel pump 302 to the cylinder head cap 1202, a number of assembly components may be reduced to simplify pump assembly while minimizing vibration of the fuel pump assembly.

Referring to FIG. 13, a plan view 1300 showing the fuel pump 302 mounted to the second embodiment of the cylinder head cap 802 having the cam cover 1102 secured above the cap is disclosed. The cam cover 1102 is mounted on the cylinder head cap 802 secured to the cylinder head, and the fuel pump 302 is secured on top of the cap via a plurality of fasteners 1305. A plurality of casings 1308 may be installed into openings 1116 formed on the cam cover 1102. Each casing 1308 may be adequately sized to receive the spark plug tube 218 containing a spark plug 1310. The cam cover 1102 may include an elevated surface 1302, a lower surface 1304, a side portion 1306 and an annular portion 1312 having an opening 1314. The elevated surface 1302 connects to the lower surface 1304 via the side portion 1306. An upstream portion of the cam cover 1102 may include curved portions 1108 and the plurality of ribs 1110. The curved portions 1108 may be formed adjacent to the elevated surface 1302.

As shown in FIG. 13, the cam cover 1102 may be mounted to the cylinder head cap 802, in such a manner that the cap mounting bosses 808 and annular boss 810 of the cap extend upward from the elevated surface 1302 of the cap. The flange 306 of the fuel pump 302 is then mounted to the cylinder head cap 802, with each flange boss 812 on the flange aligning with the corresponding cap mounting boss 808 to form a continuous opening (e.g., opening 813 shown in FIG. 9) to receive the fastener 1305. When mounted to the cylinder head cap 302, a portion of the fuel pump 302 is disposed in an opening in the annular boss 810, thereby allowing fuel to be delivered to cylinders mounted in a cylinder block secured to the cylinder head. In this way, the fuel pump 302 may be directly mounted to the cylinder head cap 802 secured to the cylinder head 200 via fasteners 1305. By directly mounting the fuel pump 302 to the cylinder head cap 802, a number of assembly components may be reduced to simplify pump assembly while minimizing vibration of the pump assembly.

Referring to FIG. 14, an alternative view 1400 showing the fuel pump 302 mounted to the cylinder head cap 802 enclosed by the cam cover 1102 is disclosed. The alternative view 1400 shows an interior region underneath the flange 306 of the fuel pump 302, a portion of the cylinder head cap 802, and cam cover 1102. The press-in-place gasket 806 is secured to a recessed slot 1403 formed adjacent to a recessed portion 1402 of the cam cover 1102. The interior region of the cam cover 1102 may include the curved portions 1108, internal ribs 1115, and openings 1116.

As shown in FIG. 14, the flange 306 of the fuel pump 302 is mounted to the cylinder head cap 802, with each flange boss 812 on the flange making face contact with the cap. As an example, each flange boss 812 of the flange 306 may align with a cap mounting boss, such as the cap mounting boss 808 shown in FIG. 9. In one example, a recessed section 1404 in each flange boss 812 may fit over the cap mounting boss 808, forming the opening 813, which may be adequately sized to receive a fastener for securing the flange 306 to the cylinder head cap 802. When mounted to the cylinder head cap 802, an inner section 1405 of the flange 306 may be in face-sharing contact with the annular boss 810 of the cap, shown in FIGS. 8 and 10A. An inner region 1406 of the fuel pump 302 may include a plurality of inner rings 1408, outer rings 1410 and an internal plug 1412. The outer rings 1410 may include a plurality of webs 1414 spaced apart along a circumference of the rings. The internal plug 1412, may be formed in a central section of the fuel pump body, such as body 304 shown in FIG. 13.

In this way, the fuel pump 302 may be directly mounted to the cylinder head cap 802 enclosed by the cam cover 1102, with a portion of the press-in-place gasket 806 positioned in the recessed slot 1403 in the cover. The cam cover may include compression tabs, wherein each compression tab has a height that controls compression of the press-in-place gasket mounted to the cam cover. By securing the press-in-place gasket 806 within the cam cover, the fuel pump is adequately secured to simplify pump assembly while minimizing fuel leakage.

FIGS. 1-14 show example configurations with relative positioning of the various components of the fuel pump and cylinder head of the engine. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space there-between and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

An example mounting system may comprise: an engine fuel pump mounted directly to a cylinder head cap positioned underneath a cam cover, the cap including a raised portion having a first and a second cap mounting boss, and a main opening for directly receiving the fuel pump, wherein each of the first and second cap mounting bosses couple to a flange formed on a bottom portion of the fuel pump. In the preceding example, additionally or optionally, the flange of the fuel pump forms a compression seal against the cap. In any or all of the preceding examples, additionally or optionally, the cam cover includes a recessed groove and compression tabs, each compression tab having a height that controls compression of a press-in-place gasket mounted to the recessed groove.

In any or all of the other examples, additionally or optionally, a sealing gasket is positioned in a recessed slot formed on a lower portion of the cap adjacent to the raised portion. In any or all of the preceding examples, additionally or optionally, a first clearance is formed between the cam cover and the raised portion of the cylinder head cap. In any or all of the preceding examples, additionally or optionally, a second clearance is formed between the cam cover and a lower portion of the cylinder head cap. In any or all of the preceding examples, additionally or optionally, each of the first and second cap mounting bosses are cylindrically shaped annular portions having openings.

In any or all of the preceding examples, additionally or optionally, the flange includes a first flange mounting boss that mates with the first cap mounting boss to form a first opening, and a second flange mounting boss that mates with the second cap mounting boss to form a second opening. In any or all of the preceding examples, additionally or optionally, the flange is secured to the cap via fasteners extended through each of the first and second openings. In any or all of the preceding examples, additionally or optionally, the cylindrical head cap includes a lower portion formed adjacent to the raised portion, the lower portion having a horizontal cross member and a plurality of vertical support members. In any or all of the preceding examples, additionally or optionally, each of the vertical support members have a plurality of openings to receive fasteners for securing the cylinder head cap to a cylinder head assembly.

In another example, an engine may comprise: a cylinder head; a cover mounted to a top of the cylinder head; a cap positioned coupled to the head, the cap having an annular top portion, a curved middle portion and a c-shaped lower portion; a fuel pump mounted directly to the cap and covered by the cover. In the preceding example, additionally or optionally, the annular top portion includes a plurality of cap mounting bosses and a main opening to receive the fuel pump. In any or all of the preceding examples, additionally or optionally, the curved middle portion includes an outer surface having a recessed slot to receive a sealing gasket. In any or all of the preceding examples, additionally or optionally, the c-shaped lower portion includes a cross member and a plurality of support members, each support member having a plurality of openings to receive fasteners for securing the cap to the cylinder head.

In a further example, a cylinder head cap may comprise: a top annular portion having a plurality of cap mounting bosses and an inner annular boss; a c-shaped lower portion having a horizontal cross member and a plurality of vertical support members, each support member having an arched opening and a plurality of slots to receive fasteners.

In any or all of the preceding examples, additionally or optionally, the c-shaped lower portion includes a recessed slot to receive a sealing gasket. In any or all of the preceding examples, additionally or optionally, the top annular portion includes a recessed slot to receive a sealing gasket. In any or all of the preceding examples, additionally or optionally, each support member includes a plurality of protrusions formed adjacent to the arched opening. In any or all of the preceding examples, additionally or optionally, the top annular portion connects to the c-shaped lower portion to form a single integral cap that couples to a cylinder head.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A mounting system comprising:

an engine fuel pump mounted directly to a cylinder head cap positioned underneath a cam cover, the cap including a raised portion having a first and a second cap mounting boss, and a main opening for directly receiving the fuel pump, wherein each of the first and second cap mounting bosses couple to a flange formed on a bottom portion of the fuel pump.

2. The mounting system of claim 1, wherein the flange of the fuel pump forms a compression seal against the cap.

3. The mounting system of claim 1, wherein the cam cover includes a recessed groove and compression tabs, each compression tab having a height that controls compression of a press-in-place gasket mounted to the recessed groove.

4. The mounting system of claim 1, wherein a sealing gasket is positioned in a recessed slot formed on a lower portion of the cap adjacent to the raised portion.

5. The mounting system of claim 1, wherein a first clearance is formed between the cam cover and the raised portion of the cylinder head cap.

6. The mounting system of claim 1, wherein a second clearance is formed between the cam cover and a lower portion of the cylinder head cap.

7. The mounting system of claim 1, wherein each of the first and second cap mounting bosses are cylindrically shaped annular portions having openings.

8. The mounting system of claim 1, wherein the flange includes a first flange mounting boss that mates with the first cap mounting boss to form a first opening, and a second flange mounting boss that mates with the second cap mounting boss to form a second opening.

9. The mounting system of claim 8, wherein the flange is secured to the cap via fasteners extended through each of the first and second openings.

10. The mounting system of claim 1, wherein the cylinder head cap includes a lower portion formed adjacent to the raised portion, the lower portion having a horizontal cross member and a plurality of vertical support members.

11. The mounting system of claim 10, wherein each of the vertical support members have a plurality of openings to receive fasteners for securing the cylinder head cap to a cylinder head assembly.

12. A cylinder head cap comprising:

a top annular portion having a plurality of cap mounting bosses and an inner annular boss; a c-shaped lower portion having a horizontal cross member and a plurality of vertical support members, each support member having an arched opening and a plurality of slots to receive fasteners, wherein the c-shaped lower portion includes a recessed slot to receive a sealing gasket.

13. The cylinder head cap of claim 12, wherein the top annular portion includes another recessed slot to receive the sealing gasket.

14. The cylinder head cap of claim 12, wherein each support member includes a plurality of protrusions formed adjacent to the arched opening.

15. The cylinder head cap of claim 12, wherein the top annular portion connects to the c-shaped lower portion to form a single integral cap that couples to a cylinder head.

* * * * *